US008480382B2

(12) United States Patent
Wang

(10) Patent No.: US 8,480,382 B2
(45) **Date of Patent: *Jul. 9, 2013**

(54) ELECTROMAGNETIC PUMP WITH FREQUENCY CONVERTER CIRCUIT

(75) Inventor: Ming Yang Wang, Nantou (TW)

(73) Assignee: Jackey Chiou, Nantou (TW)

( * ) Notice: Subject to any disclaimer, the term of this patent is extended or adjusted under 35 U.S.C. 154(b) by 293 days.

This patent is subject to a terminal disclaimer.

(21) Appl. No.: 12/894,178

(22) Filed: Sep. 30, 2010

(65) Prior Publication Data

US 2012/0082574 A1 Apr. 5, 2012

(51) Int. Cl.
*H02K 41/02* (2006.01)

(52) U.S. Cl.
USPC ..... 417/413.1; 318/123; 318/129; 318/132

(58) Field of Classification Search
USPC ..... 417/413.1; 318/123–126, 129, 132
See application file for complete search history.

(56) References Cited

U.S. PATENT DOCUMENTS 3,340,052 A * 9/1967 Inoue ..... 419/19
3,875,483 A * 4/1975 Farr ..... 318/807
4,374,330 A * 2/1983 Fey ..... 307/132 E
5,137,432 A * 8/1992 Tsai ..... 417/312
5,160,274 A * 11/1992 Ozaki et al. ..... 439/212
6,168,392 B1 * 1/2001 Takano ..... 417/312
6,340,069 B1 * 1/2002 Wang ..... 181/272
2010/0286597 A1 * 11/2010 Wang ..... 604/35
2012/0053519 A1 * 3/2012 Wang ..... 604/131

* cited by examiner

*Primary Examiner* — Charles Freay
(74) *Attorney, Agent, or Firm* — Raymond Y. Chan; David and Raymond Patent Firm

(57) ABSTRACT

An electromagnetic pump has a frequency converter circuit for driving the electromagnetic pump, wherein the frequency converter circuit comprises an oscillator circuit, a bistable circuit and a push-pull circuit. The oscillator circuit oscillates to transform DC into a single-phase oscillating signal. The bistable circuit splits the single-phase oscillating signal into a N-phase stimulus signal and a S-phase stimulus signal. The push-pull circuit amplifies and transports the N-phase stimulus signal and the S-phase stimulus signal to the electromagnetic pump to make the swing arms of the electromagnetic pump swinging effectively, wherein the swing speed, the swing frequency and the swing amplitude of the swing arms vary with the change of the oscillation frequency of the oscillator circuit. Thereby, the suction pressure and the discharge pressure of the electromagnetic pump could further be adjusted higher or lower, wherein said frequency converter circuit comprises a modulation circuit, which could change the swing speed of the swing arms swinging outwardly or inwardly to further increase or decrease the suction pressure or the discharge pressure.

8 Claims, 32 Drawing Sheets

ELECTROMAGNETIC PUMP WITH FREQUENCY CONVERTER CIRCUIT

BACKGROUND OF THE PRESENT INVENTION

1. Field of Invention

The present invention relates to electromagnetic pump, and more particularly to an electromagnetic pump with a frequency converter circuit, wherein the swinging speed, frequency and amplitude of the swing arms thereof are adjustable to change the suction pressure or the discharge pressure thereof.

2. Description of Related Arts

Taiwan patent application No. 092217183 "Nasal Cavity Cleaning and Atomizing Treatment Device" (hereinafter, the first prior art) discloses a device for suctioning snot, cleaning the nasal cavity and atomizing a fluid with medicine to the nasal cavity to treat the sickness of nasopharynx. The device comprises a chamber and a bladder expending and compressing to respectively draw a gas into the chamber through an inlet and discharge the gas from the chamber through an outlet. If a suction device is connected to the inlet, the device will become a device with the function of suctioning snot. If an atomizer is connected to the inlet, the device will become a device with the function of atomizing medicine. However, the power source of the device is a motor with a rotor, which rotates to drive a shaft of the motor forth and back with a predetermined distance. The quicker the rotor rotates, the bigger the suction force or the discharge force generated in the chamber is, wherein the flow increases along with the generated pressure. As the device in the first prior art is a device with multiple functions, it is safe to use it for atomization treatment; however, when it is used to suction the snot, it might hurt the nasal cavity due to the over suction force, and that when it is used to clean the nasal cavity, it might cause a choke due to the over discharge force. Besides, the motor has a lot of defects, such as high power consumption, big bulk, a lot of noise, too big suction force, too big discharge force, high-heat, short service life, unbearable of wetting. Hence, the device is not a proper power source for the medical apparatus and instruments that are required to contact with human body.

It is well known that the electromagnetic pump has several advantages, such as less weight, less noise, lower power consumption, hard to generate high-heat, no short circuit when the inlet channel or the outlet channel is blocked. Hence, the electromagnetic pump is a better choice to be used as the power source of the medical apparatus and instruments that are required to contact with human body. Taiwan patent application No. 092218142 "Gas Filler for Air Bed" (hereinafter, "the second prior art") discloses an electromagnetic pump for transporting the gas to filling the air bed. The second prior art was filed by the applicant in 1992. Taiwan patent application No. 09307116 "Electromagnetic Pump with Swappable Drawing Direction and Discharge Direction" (hereinafter, "the third prior art") and Taiwan patent application No. 093217312 "Easy-Clean Electrical Snot Suction Device" (hereinafter, "the forth prior art") disclose an electromagnetic pump using gas and/or liquid due to the development made by the applicant. Referring to FIG. 1, the electromagnetic pump could only use the AC to make the swing arm 25 swinging forth and back. Around the world, the electricity for home use is generally 110V or 220V, for example the electricity supplied in Taiwan is a single-phase power source with 110V and 60 Hz. Hence, when 110V and 60 Hz AC is used as the power source of the electromagnetic pump, the magnetic field intensity generated in the electromagnetic device 27, the length and width of the swing arm 25, the magnetic field intensity of the magnetic member 26, and the elasticity of the bladder 24 are limited and coupled in such a manner that the swing speed, the swing frequency and the swing amplitude of the swing arm 25 of the electromagnetic pump 20 are fixed and nonadjustable. As shown in FIG. 1, the amplitude W4, the swing speed and the swing frequency of the swing arm 25 are retained in a fixed value and could not be changed after the electromagnetic pump is manufactured. However, the swing speed, the swing frequency and the swing amplitude of the swing arm 25 affect the suction pressure, the suction flow, the discharge pressure, and the discharge flow of the electromagnetic pump 20. It means that due to the limitations mentioned above, the suction pressure, the suction flow, the discharge pressure, and the discharge flow of the current electromagnetic pump could not be adjusted according to the required pressure and flow. However, it is a future trend to use medical apparatus and instruments with multiple functions, and thus there is a room for improvement to provide the electromagnetic pump using the gas and/or the liquid with adjustable ability in suction pressure, suction flow, discharge pressure, and discharge flow with respect to the desired functions.

SUMMARY OF THE PRESENT INVENTION

In view of that the medical apparatus and instruments, such as snot suction device, lattices suction device, nose cleaner, atomizer, teeth cleaner, tongue cleaner, and etc., are required to have the advantages of low power consumption, less electric consumption, less noisy, compact size, prevention of generating high-heat, waterproof, and etc., the applicant of the present invention invents an electromagnetic pump to achieve the advantages mentioned above and below after a series of researches and experiments.

The invention is advantageous in that it provides an electromagnetic pump with a frequency converter circuit, which converts the DC to AC power for supplying the electromagnetic pump, wherein when the electromagnetic pump is drawing or discharging a gas or a liquid, the oscillation frequency of the frequency converter circuit is able to be adjusted to change the electromagnetic pump into a medium pressure and medium flow mode, or a lower pressure and higher flow mode, or a higher pressure and lower flow mode.

The invention is advantageous in that it provides an electromagnetic pump with a N-phase or S-phase frequency converter circuit, which could accelerate the swing speed of the swing arm swinging outwardly to further increase the suction pressure of the electromagnetic pump or accelerate the swing speed of the swing arm swinging inwardly to further increase the discharge pressure of the electromagnetic pump, thereby the medical apparatus and instruments using the electromagnetic pump as power source could be used with any proper electrical power in any place.

Additional advantages and features of the invention will become apparent from the description which follows, and may be realized by means of the instrumentalities and combinations particular point out in the appended claims.

According to the present invention, the foregoing and other objects and advantages are attained by an electromagnetic pump with a frequency converter circuit, which converts DC to AC power for supplying the electromagnetic pump. The electromagnetic pump has an electromagnetic device on one side and a pump housing on the other side, wherein at least one outside surface of the pump housing provides a stretchable and elastic bladder which further provides a swing arm thereon. One end of the swing arm is pivotally mounted on an outer side of the pump housing while a magnetic member is provided on the other end of the swing arm with a distance from the electromagnetic device. The inside of the pump housing is divided into a first chamber and a second chamber, wherein the first chamber is communicated with at least one inlet tube and the second chamber is communicated with at least one outlet tube. A check valve is provided between each of the first and second chambers and the corresponding bladder. The swing arms swing reciprocatingly to cause the electromagnetic pump draw a fluid into the pump from the inlet tube and discharge the fluid from the outlet tube.

The frequency converter circuit comprises an oscillator circuit, a bistable circuit and a push-pull circuit. The oscillator circuit oscillates to transform DC into a single-phase oscillating signal. The bistable circuit splits the single-phase oscillating signal into a N-phase stimulus signal and a S-phase stimulus signal, both of which respectively activate magnetism of two side magnetic members of the electromagnetic device and magnetism of middle magnetic member of the electromagnetic device to alternating switch between N-phase and S-phase. The two side magnetic members and the middle magnetic member are attracted or repulsed by the two magnetic members respectively to force the swing arms to swing reciprocatingly. The higher the oscillating frequency of the oscillator circuit being adjusted to, the higher the speed of the switching between the N-phase and the S-phase of the electromagnetic device is. The lower the oscillating frequency of the oscillator circuit being adjusted to, the lower the speed of the switching between the N-phase and the S-phase of the electromagnetic device is. The push-pull circuit amplifies and transports the N-phase stimulus signal and the S-phase stimulus signal to the electromagnetic pump to force the swing arms of the electromagnetic pump to swing effectively. The frequency converter circuit is arranged to use DC to activate the swing arms of the electromagnetic pump to swing reciprocatingly. The oscillating frequency of the oscillator circuit is adjusted to change the swing speed, the swing frequency and the swing amplitude of the swing arms of the electromagnetic pump, so as to further change the suction pressure, the suction flow, the discharge pressure and the discharge flow.

The oscillator circuit could be connected to a button or a keypad, which is arranged to adjust the oscillating frequency of the oscillator circuit. In another embodiment of the present invention, the frequency converter circuit further comprises a modulation circuit which generates a single-phase oscillating signal. The N-phase stimulus signal and the S-phase stimulus signal generated in the bistable circuit are mixed with the single-phase oscillating signal respectively to enhance the N-phase stimulus signal while balancing the S-phase stimulus signal or to enhance the S-phase stimulus signal while balance the N-phase stimulus signal. The enhancement of the magnetic field strength of the N-phase of the electromagnetic device respectively further causes the swing arms swinging outwardly with a higher speed and a bigger force and swinging inwardly with a lower speed and a smaller force, thereby the suction pressure of the electromagnetic pump is increased and the discharge pressure of the electromagnetic pump is decreased. The enhancement of the magnetic field strength of the S-phase of the electromagnetic device respectively further causes the swing arms swinging inwardly with a lower speed and a smaller force and swinging outwardly with a higher speed and a bigger force, thereby the discharge pressure of the electromagnetic pump is increased and the suction pressure of the electromagnetic pump is decreased. The modulation circuit is connected to a button or a keypad, which is arranged to activate or adjust the modulation circuit. The DC inputted into the frequency converter circuit could be supplied by an in-car cigarette lighter, by a battery, or by a transformer rectifier unit.

The container has a containing space for storing a cleaning solution and is communicated with the inlet tube of the electromagnetic pump through a negative pressure channel. Thereby the cleaning solution in the container could provide fluid in the electromagnetic pump.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
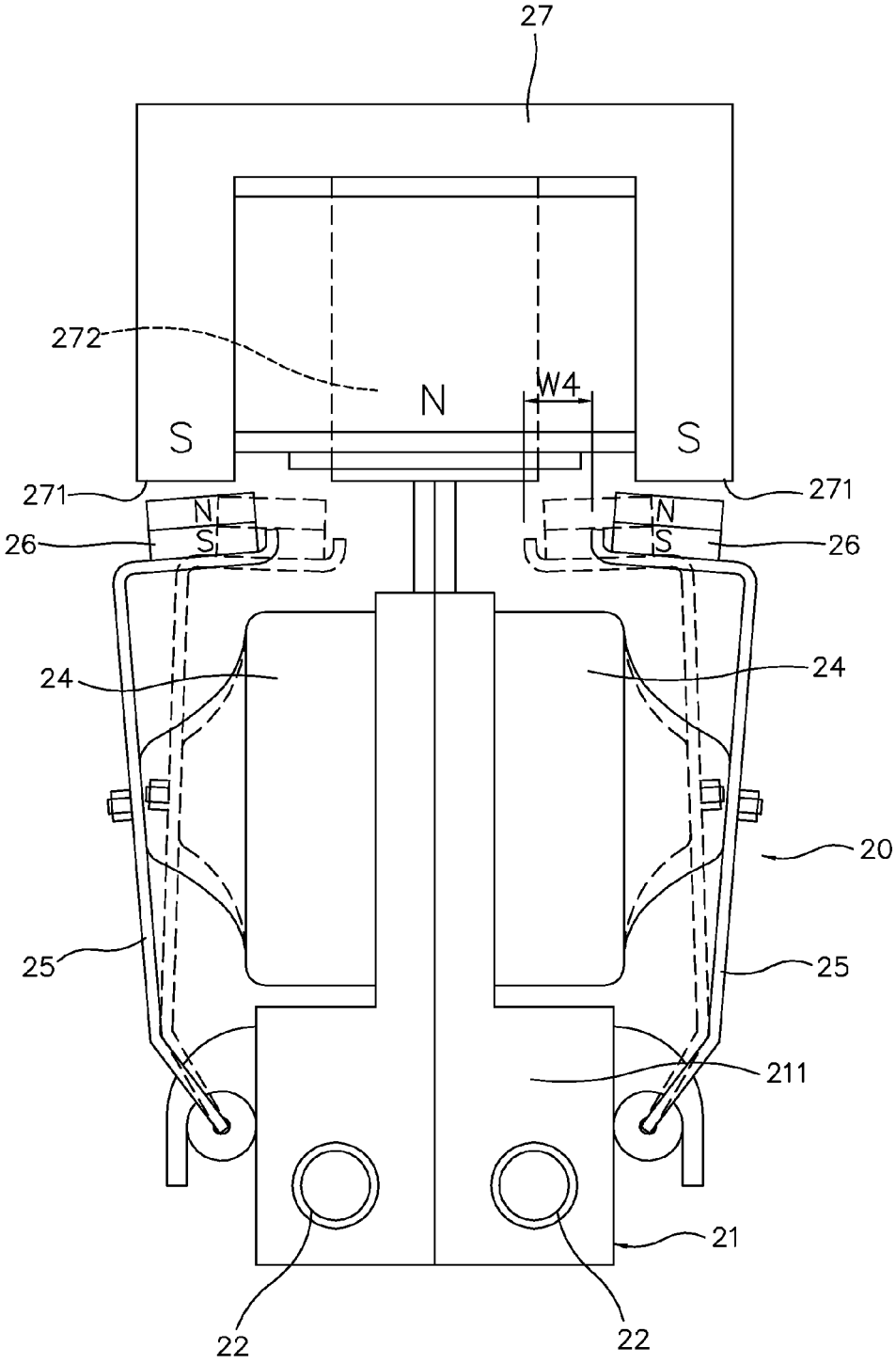
FIG. 1 is a schematic diagram of an electromagnetic pump illustrating the swinging of the swing arms.
Figure 2:
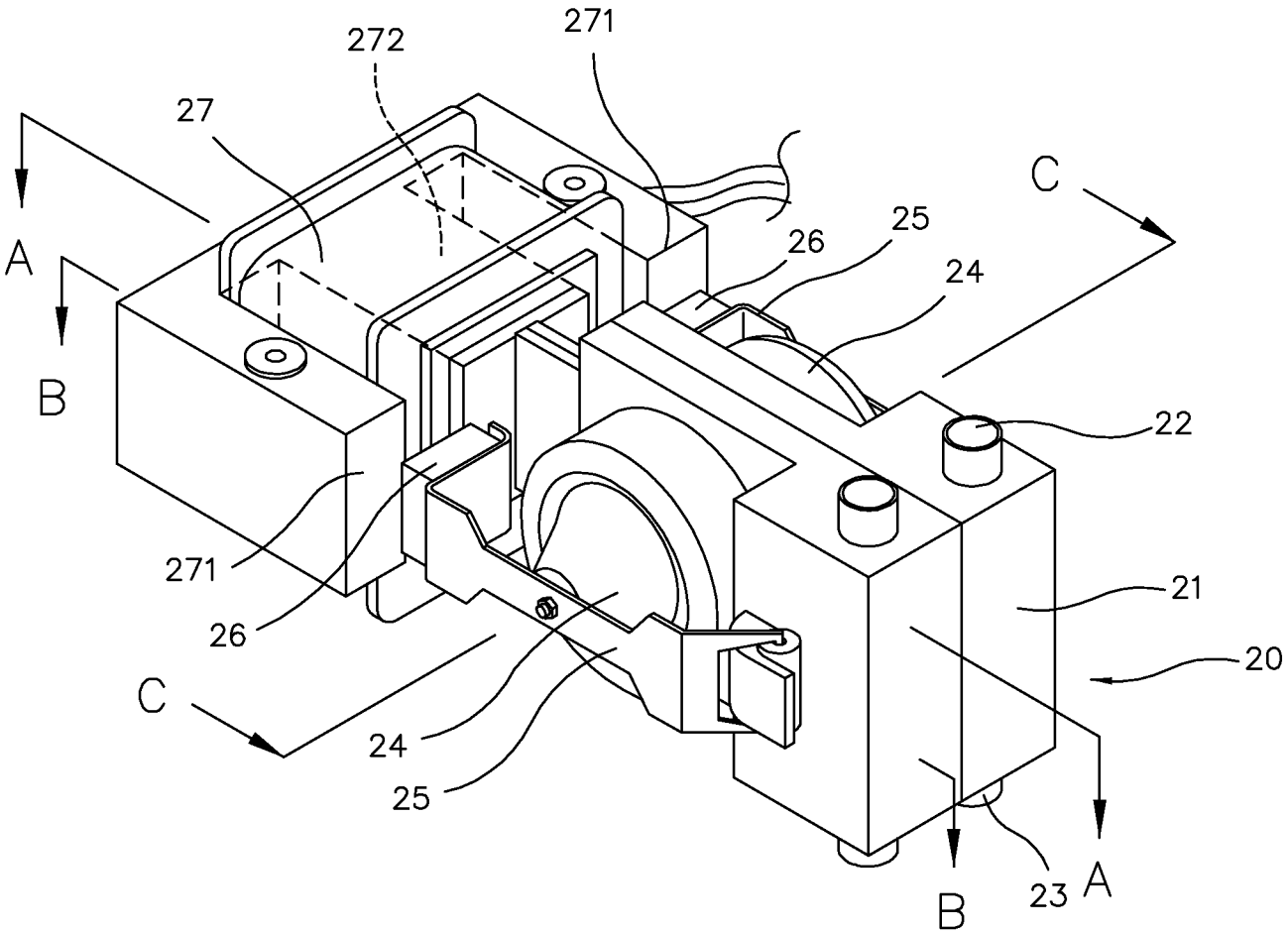
FIG. 2 is a schematic diagram of an electromagnetic pump according to a preferred embodiment of the present invention.
Figure 3:
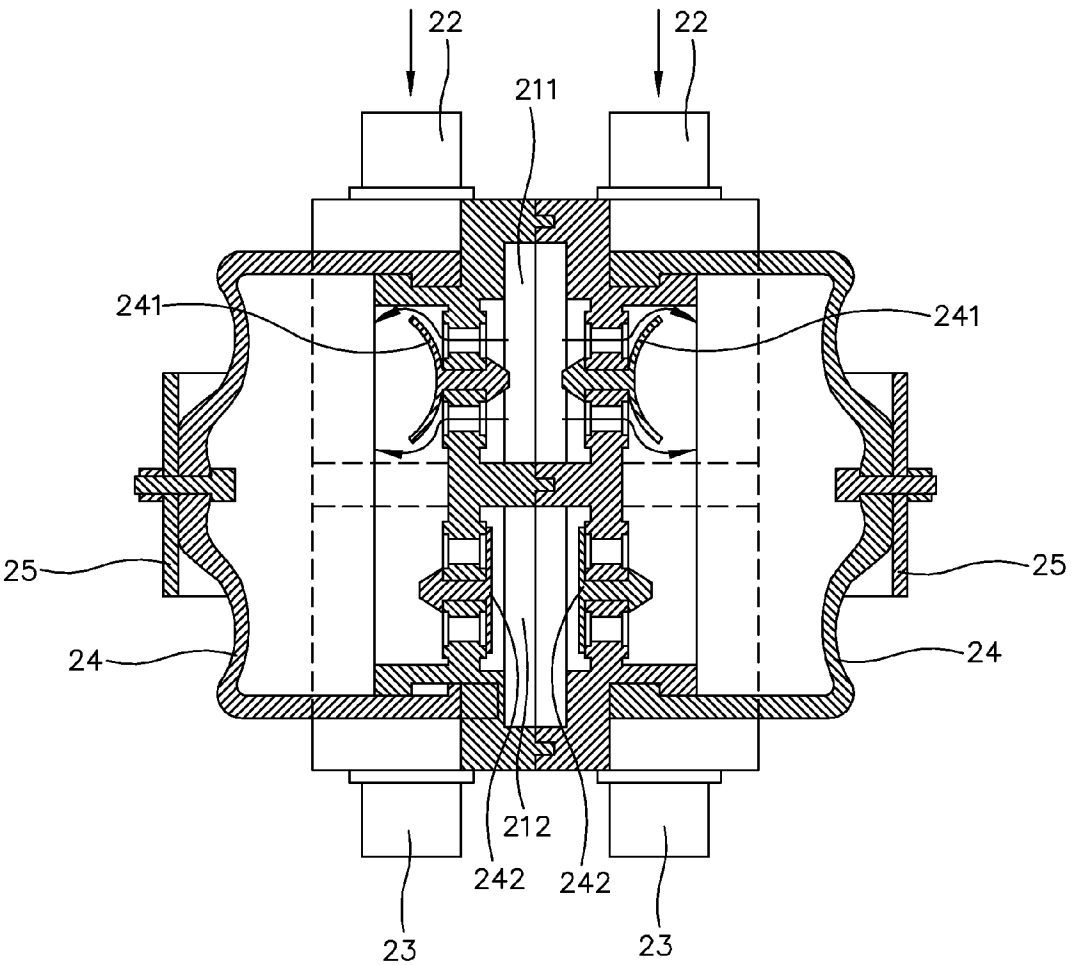
FIG. 3 is a C-C section view of the electromagnetic pump of FIG. 2 illustrating the flow direction of the fluid drawn by the electromagnetic pump.

Referring to FIGS. 2 to 6, the electromagnetic pump 20 of the present invention comprises an electromagnetic device 27 surrounded with coils on one side and a pump housing 21 on the other side. Each of two outside surfaces of the pump housing 21 provides a stretchable and elastic bladder 24 which further provides an swing arm 25 thereon, wherein one end of each of the swing arms 25 is pivotally mounted on the outer side of the pump housing 21 while a magnetic member 26 is provided on the other end of each swing arm 25 with a distance from the electromagnetic device 27. The inside of the pump housing 21 is divided into two chambers, including a first chamber 211 in the upper portion and a second chamber 212 in the lower portion. The first chamber 211 is communicated with two inlet tubes 22 and the second chamber 212 is communicated with the outlet tube 23.

Figure 4:
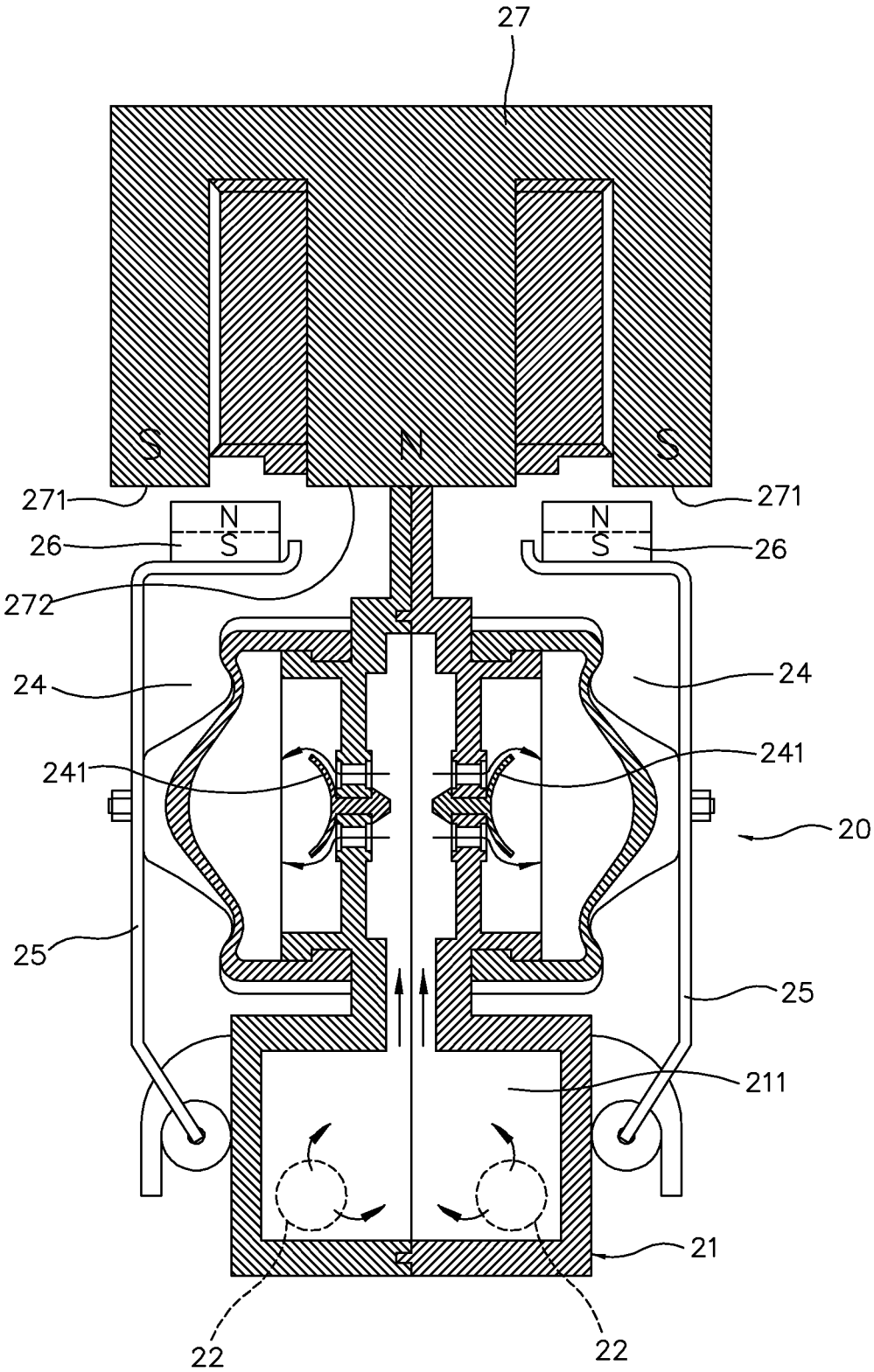
FIG. 4 is an A-A section view of the electromagnetic pump of FIG. 2 illustrating the flow direction of the fluid drawn by the electromagnetic pump.
Figure 5:
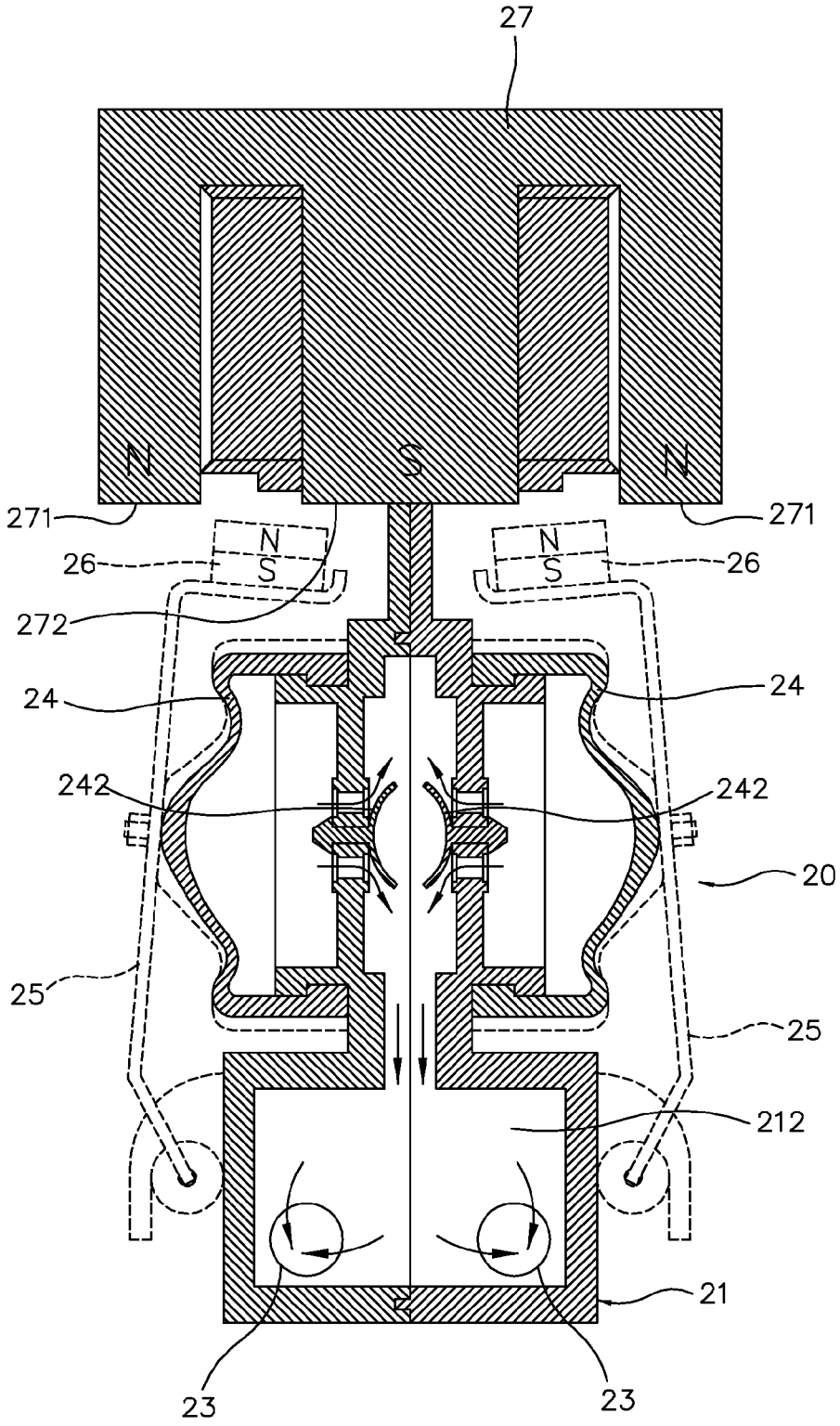
FIG. 5 is a B-B section view of the electromagnetic pump of FIG. 2 illustrating the flow direction of the fluid discharged by the electromagnetic pump.
Figure 6:
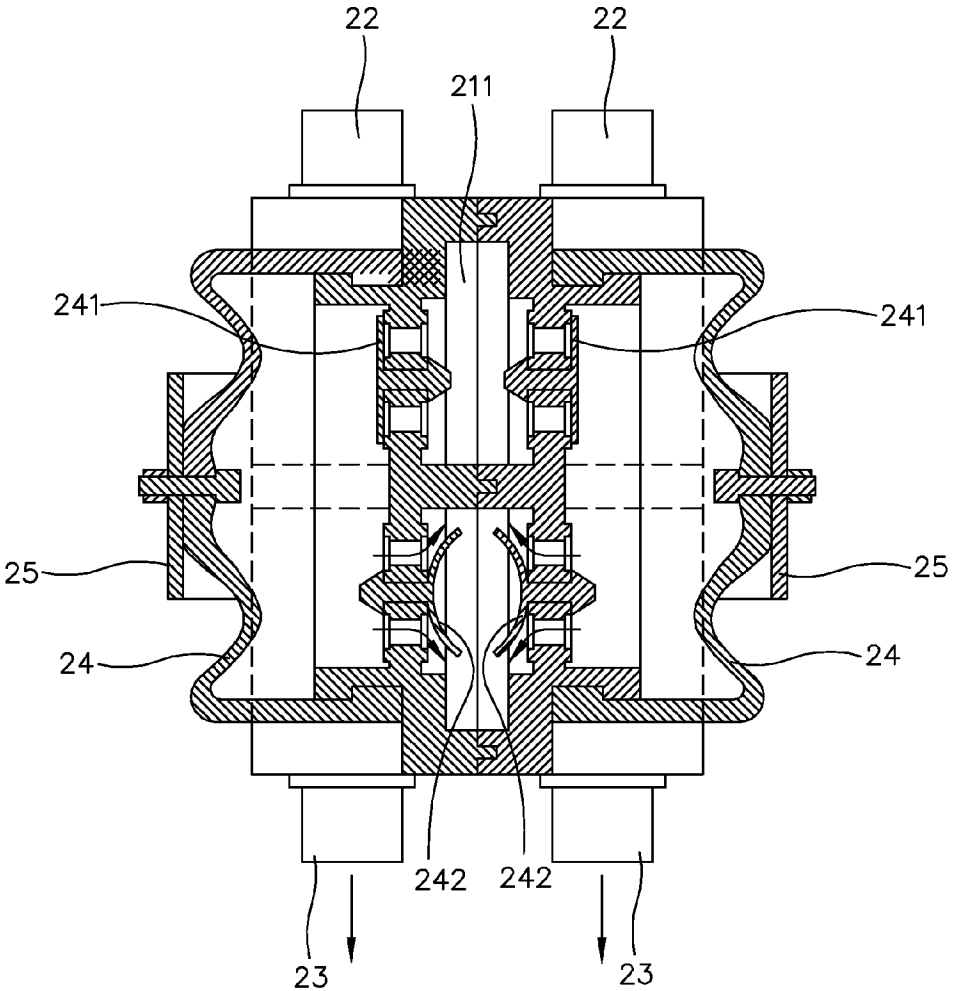
FIG. 6 is a C-C section view of the electromagnetic pump of FIG. 2 illustrating the flow direction of the fluid discharged by the electromagnetic pump.

Referring to FIGS. 4 and 5, the electromagnetic device 27 has two side magnetic members 271 and a middle magnetic member 272, wherein the magnetism of the three members alternate between a N-phase and a S-phase. The two magnetic members 26 are disposed in opposite to the two side magnetic members 271 respectively and have N-phase outside surfaces and S-phase inside surfaces respectively.

As shown in FIG. 4, when the two side magnetic members 271 of the electromagnetic device 27 switch to S-phase and the middle magnetic member 272 switches to N-phase, the two magnetic members 26 are attracted by the middle magnetic member 272 and are repulsed by the two side magnetic members 271 to bring the swing arms 25 towards the outside. Oppositely, as shown in FIG. 5, when the two side magnetic members 271 of the electromagnetic device 27 switch to N-phase and the middle magnetic member 272 switches to S-phase, the two magnetic members 26 are repulsed by the middle magnetic member 272 and are attracted by the two side magnetic members 271 to bring the swing arms 25 towards the middle.

Referring to FIGS. 3-6, when the swing arms 25 swing towards the outside to expand the bladders 24 respectively, the two first check valves 241 respectively provided between the pump housing 21 and the bladders 24 are set to open (as shown in FIG. 4) to allow a fluid flowing into the first chamber 211 through the inlet tubes 22 on the outside of the pump and flowing substantially into the two bladder 24. Then, the fluid is stopped from flowing into the second chamber 212 by two second check valves 242 (as the two second check valves 242 are turned off). And when the two swing arm 25 swing towards the middle to compress the two bladders 24 respectively, the two second check valves 242 are turned on and the first check valves 241 are turned off. Hence the fluid in the two bladders 24 could only flow into the second chamber 212 but not reflow back into the first chamber 211, and thus the fluid in the second chamber 212 is capable of discharging from the pump housing 21 through the two outlet tubes 23. In view of the mentioned designs, the pump housing 21 draws a fluid from the inlet tubes 22 and then discharges the fluid from the outlet tube 23 to deliver the fluid.

Although as mentioned in the above embodiment, there are two swing arms 25 and two bladders 24 arranged left and right, one swing arm and one bladder could also be used according to the requirement. In addition, although the two swing arms 25 in the above embodiment are arranged as both swinging outwardly or both swinging inwardly, the two swing arms 25 could also be arranged as alternatively both swinging left and both swinging right. The delivering fluid could be gas, liquid or a mixture of gas and liquid.

Figure 7:
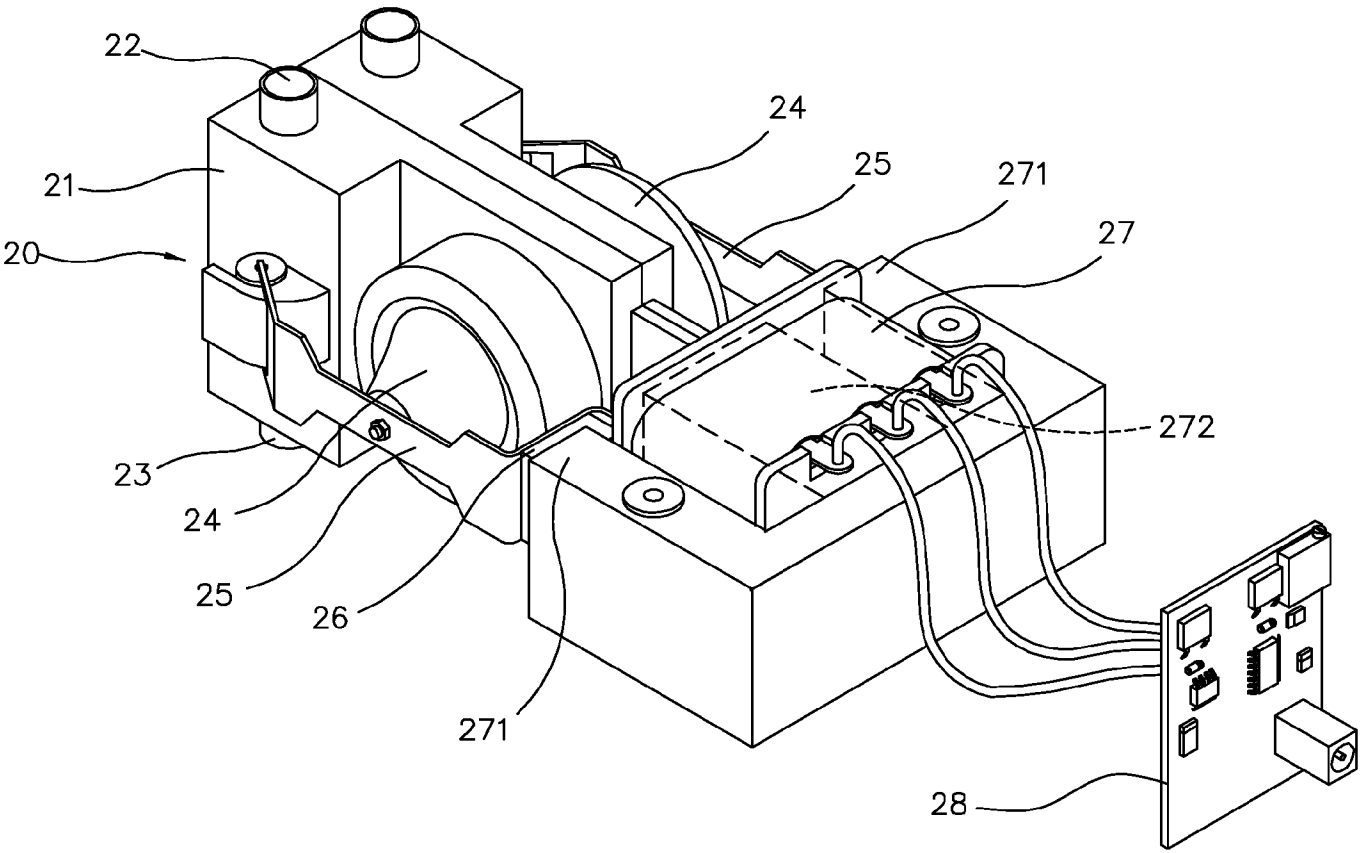
FIG. 7 is a perspective view of the electromagnetic pump connected with the frequency converter circuit according to the above preferred embodiment of the present invention.
Figure 8A:
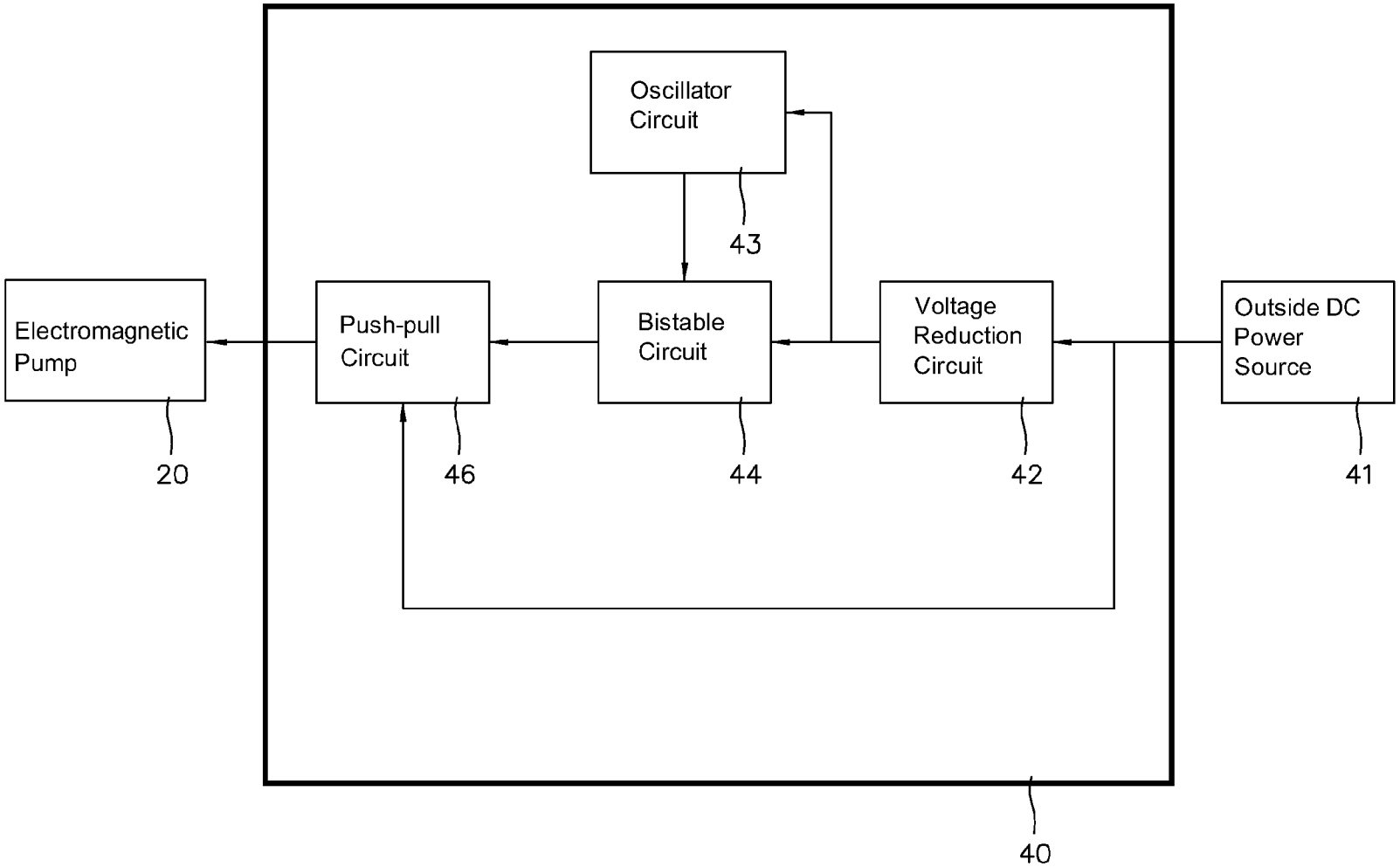
FIG. 8A is a block flow chart of a frequency converter circuit according to the above preferred embodiment of the present invention.
Figure 8B:
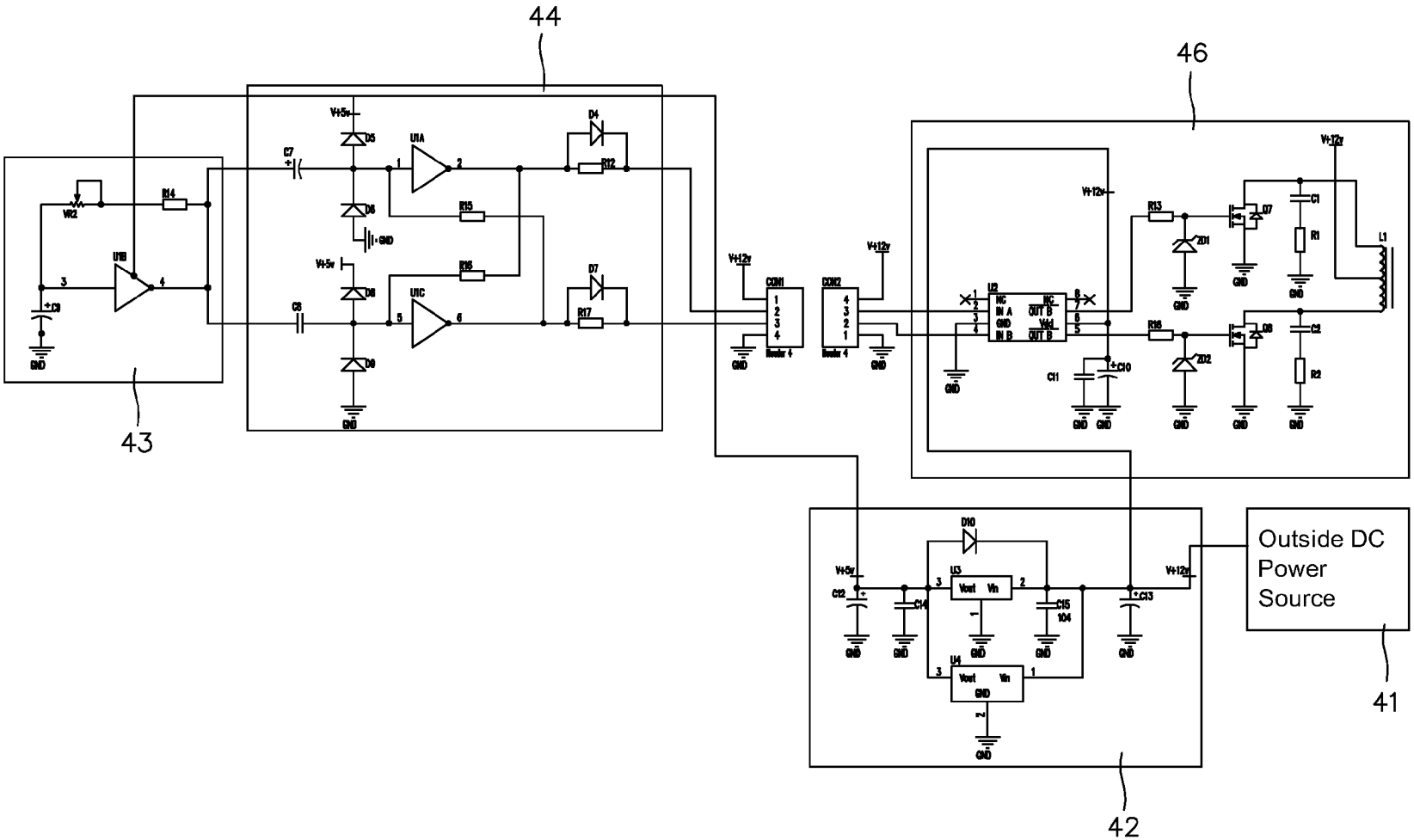
FIG. 8B is a circuit view of the frequency converter circuit of FIG. 8A.

Referring to FIGS. 7, 8A and 8B, the electromagnetic pump in the preferred embodiment is connected with a circuit board 28, which further has a frequency converter circuit 40 provided thereon. The frequency converter circuit 40 comprises a voltage reduction circuit 42, an oscillator circuit 43, a bistable circuit 44, and a push-pull circuit 46, wherein the oscillator circuit 43 could be a Schmitt oscillator circuit.

Figure 21:
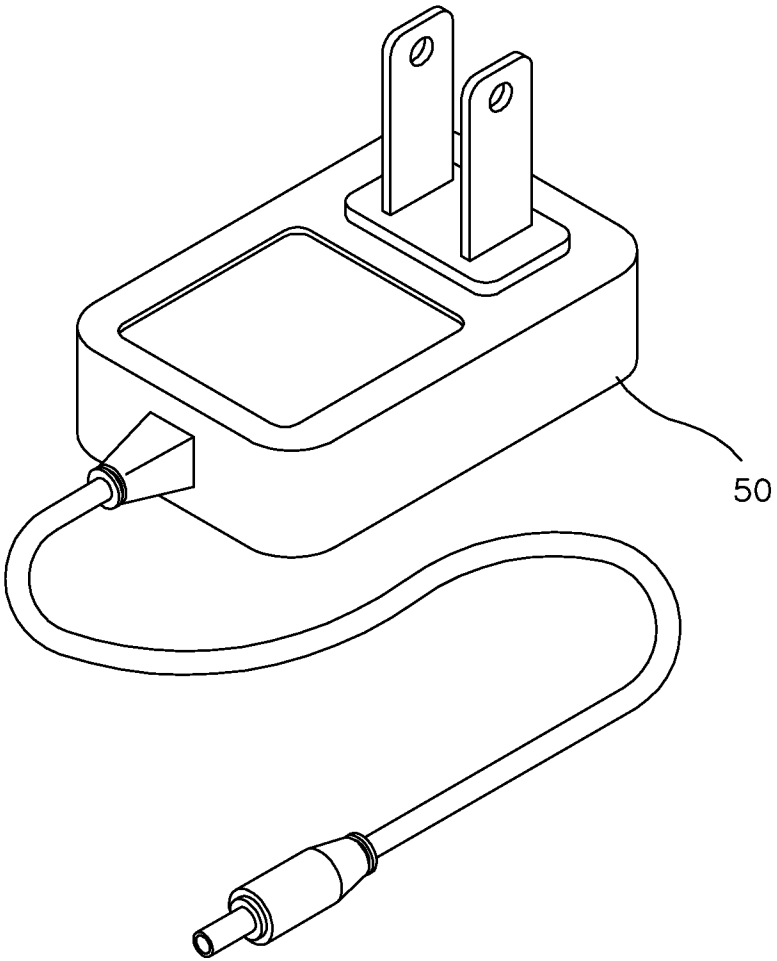
FIG. 21 is a schematic diagram of a transformer rectifier unit.
Figure 22:
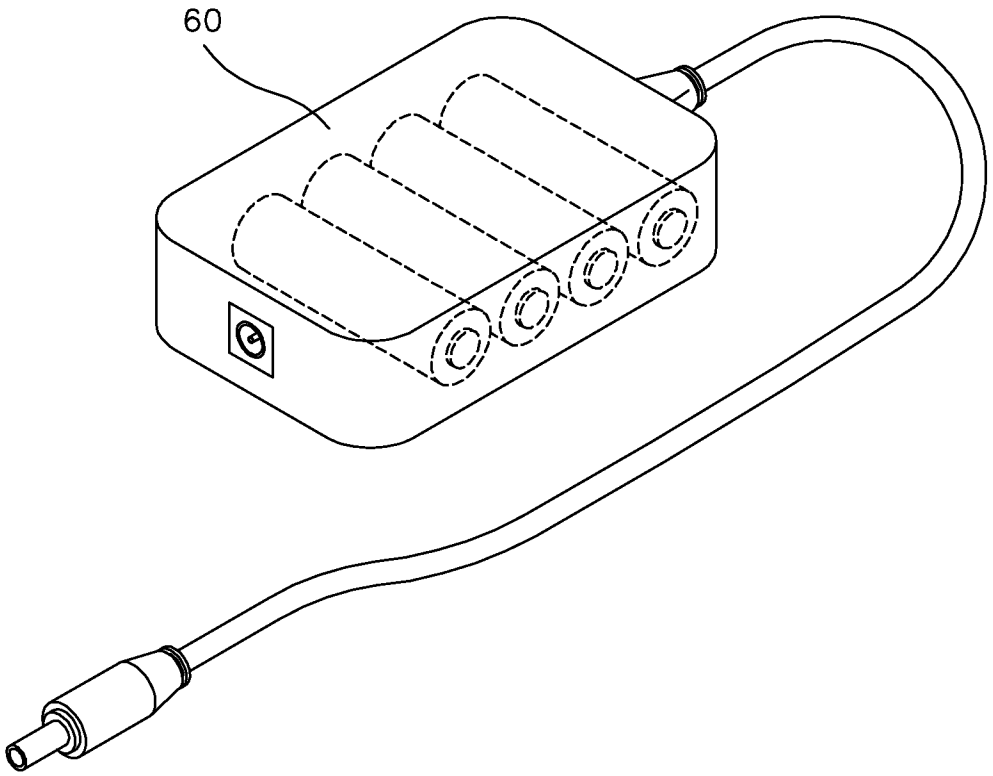
FIG. 22 is a schematic diagram of a battery.
Figure 23:
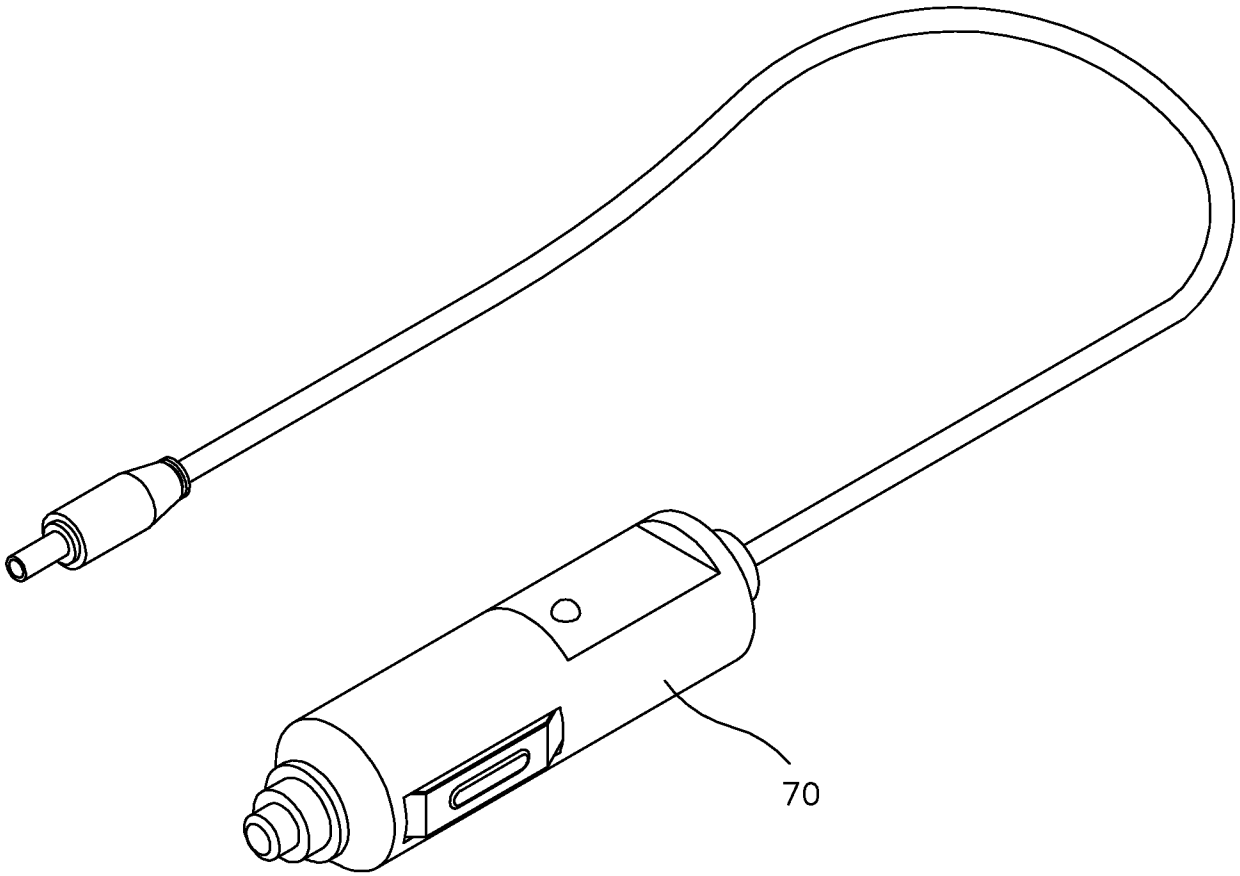
FIG. 23 is a schematic diagram of the electric wire particularly used for the in-car cigarette lighter.

The voltage reduction circuit 42 transforms the 12V DC inputted by the outside DC power source 41 to 5V DC, which is supplied to each circuit as the working current, wherein the voltage reduction circuit 42 could be used to stabilize the voltage. Referring to FIGS. 21 to 23, the DC could be supplied by a transformer rectifier unit, or a battery 60, or an electric wire particularly used for the in-car cigarette lighter. Hence, the electromagnetic pump of the present invention could be used at home or in car or outside with any proper electrical power source.

Figure 24:
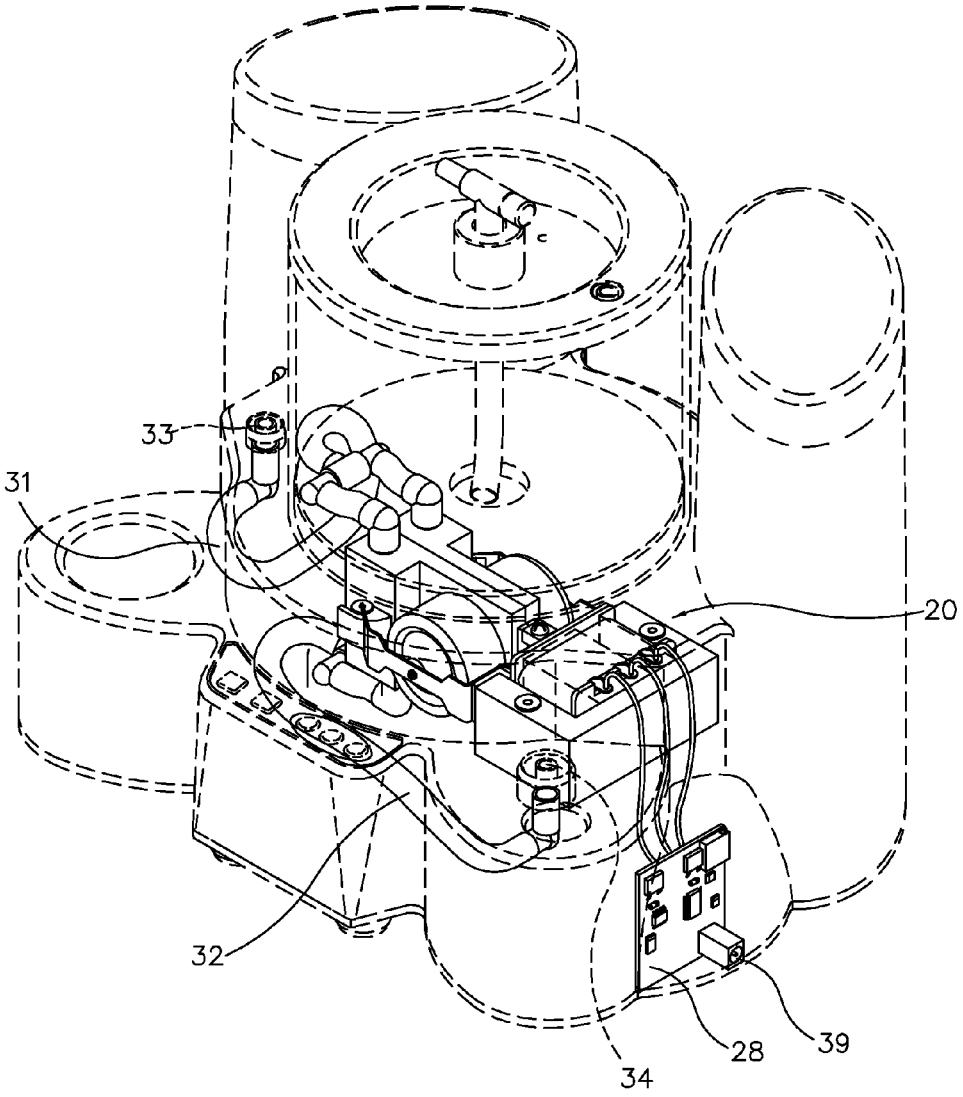
FIG. 24 is a schematic diagram of the electromagnetic pump received in a body according to the above preferred embodiment of the present invention.
Figure 25:
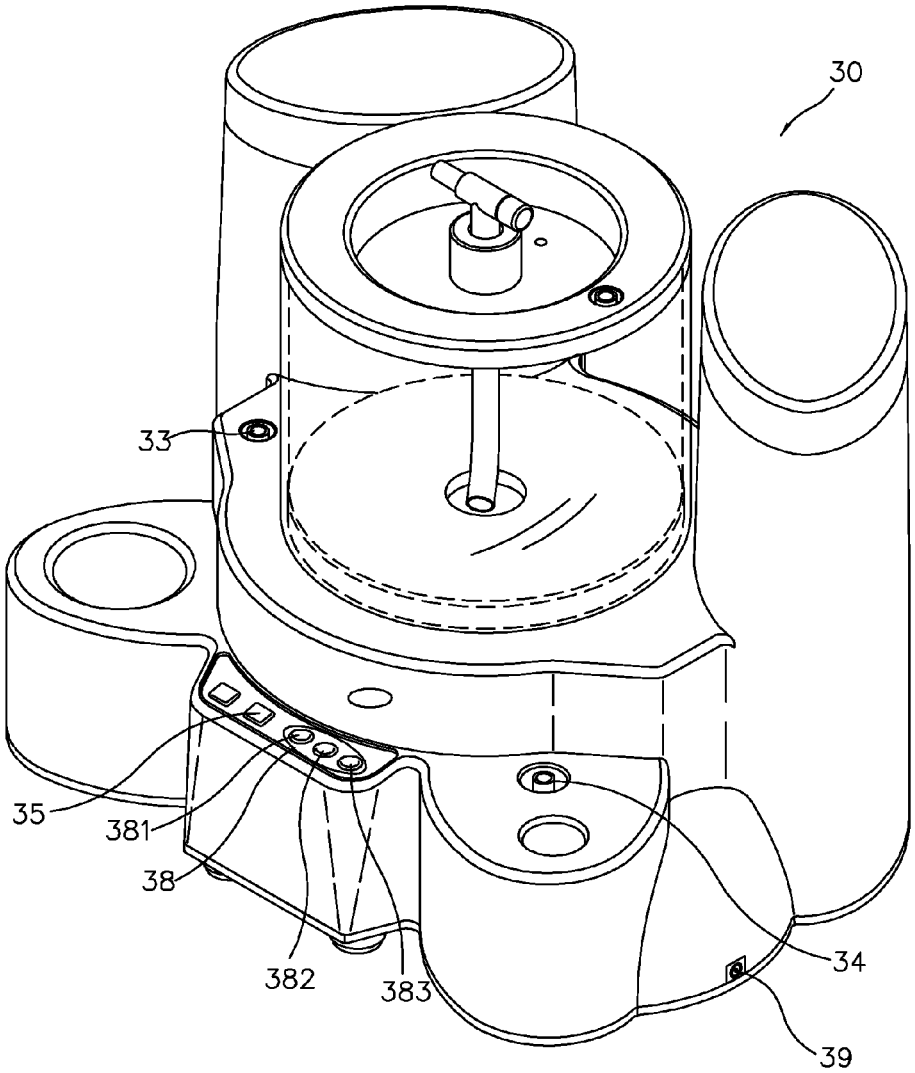
FIG. 25 is a schematic diagram illustrating the connection between the modulation circuit and the keypad on the outside surface according to the above preferred embodiment of the present invention.
Figure 26:
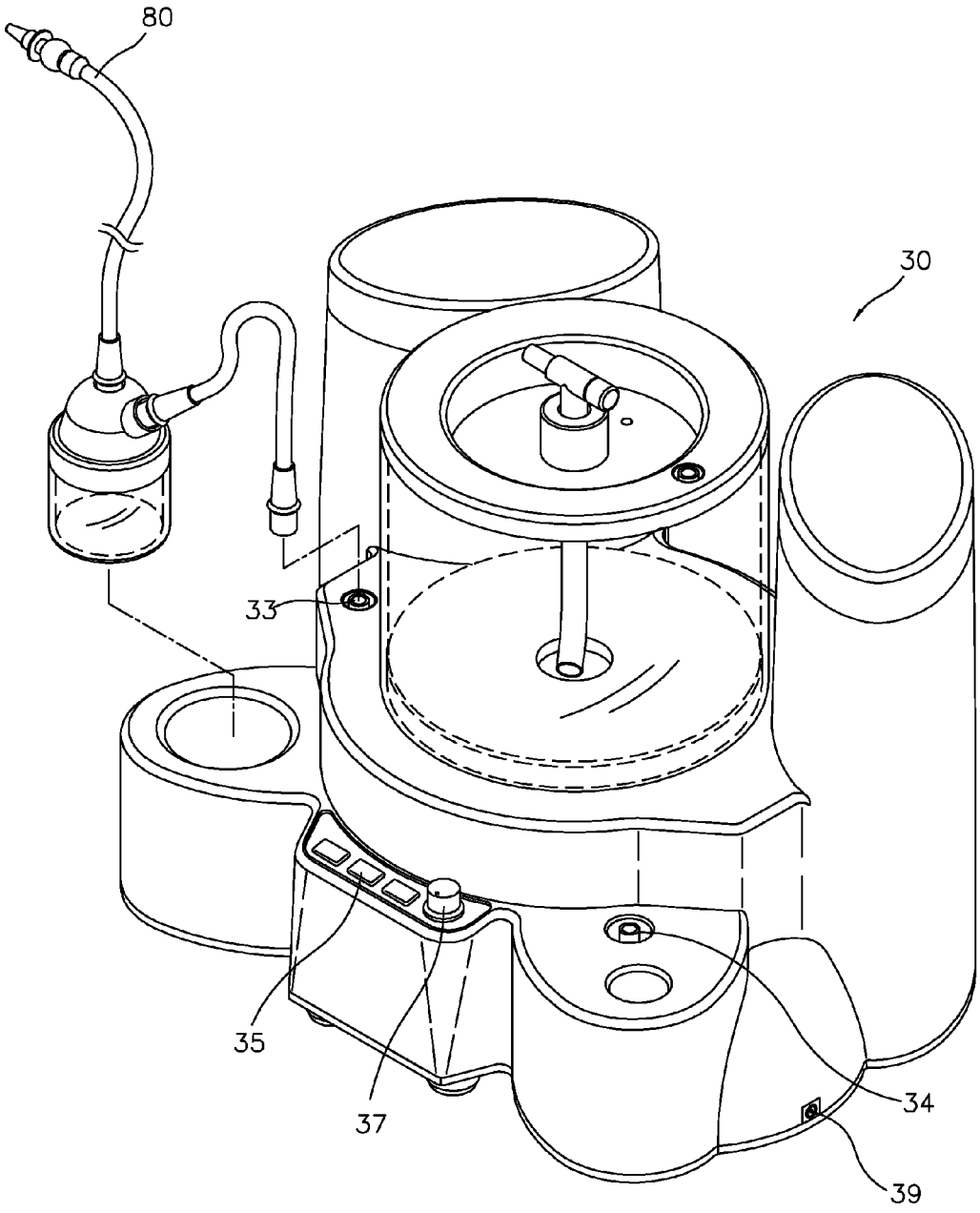
FIG. 26 is a schematic diagram illustrating the connection between the modulation circuit and the button on the outside surface according to the above preferred embodiment of the present invention.

The oscillator circuit 43 could be a Schmitt oscillator circuit, which oscillates to transform a 12V DC into a single-phase oscillating signal with an oscillating frequency between 43 Hz to 66 Hz. Referring to FIGS. 24 and 25, the electromagnetic pump 20 and the circuit board 28 of the embodiments could be contained in a body 30. The oscillator circuit 43 is connected to a keypad 38 of the body 30. The keys 381, 382 and 383 of the keypad 38 are arranged to activate the oscillator circuit 43 and to adjust the oscillation frequency of the oscillator circuit 43. Referring to FIG. 26, the oscillator circuit 43 could also be connected to a button 37, which is arranged to activate the oscillator circuit 43 and to adjust the oscillation frequency of the oscillator circuit 43.

The bistable circuit 44 splits the single-phase oscillating signal into a N-phase stimulus signal and a S-phase stimulus signal, both of which cause a DC changed into AC and respectively activate the magnetism of the two side magnetic members 271 and the magnetism the middle magnetic member 272 to alternatively switch between N-phase and S-phase continuously, while the two side magnetic members 271 and the middle magnetic member 272 are attracted or repulsed by the two magnetic members 24 respectively to force the swing arms 25 to swing reciprocatingly to compress or expand the bladders 24 respectively.

The push-pull circuit 46 amplifies the N-phase stimulus signal and the S-phase stimulus signal to force the swing arms 25 of the electromagnetic pump 20 to swing effectively to further improve the power of the electromagnetic pump 20.

Figure 9:
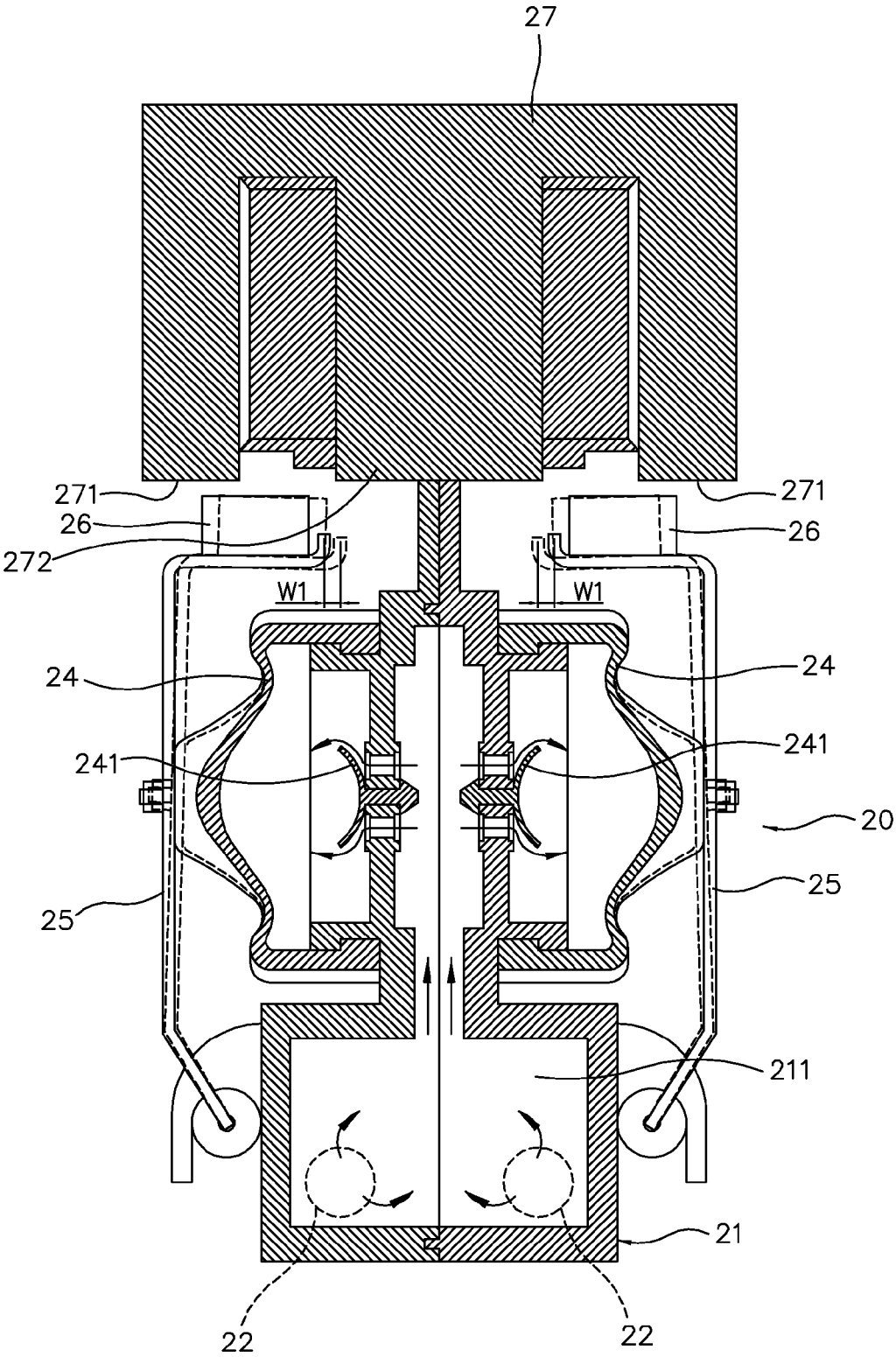
FIG. 9 is a schematic diagram of the electromagnetic pump according to the above preferred embodiment of the present invention illustrating the swinging of the swing arms with maximum frequency and minimum amplitude.
Figure 10:
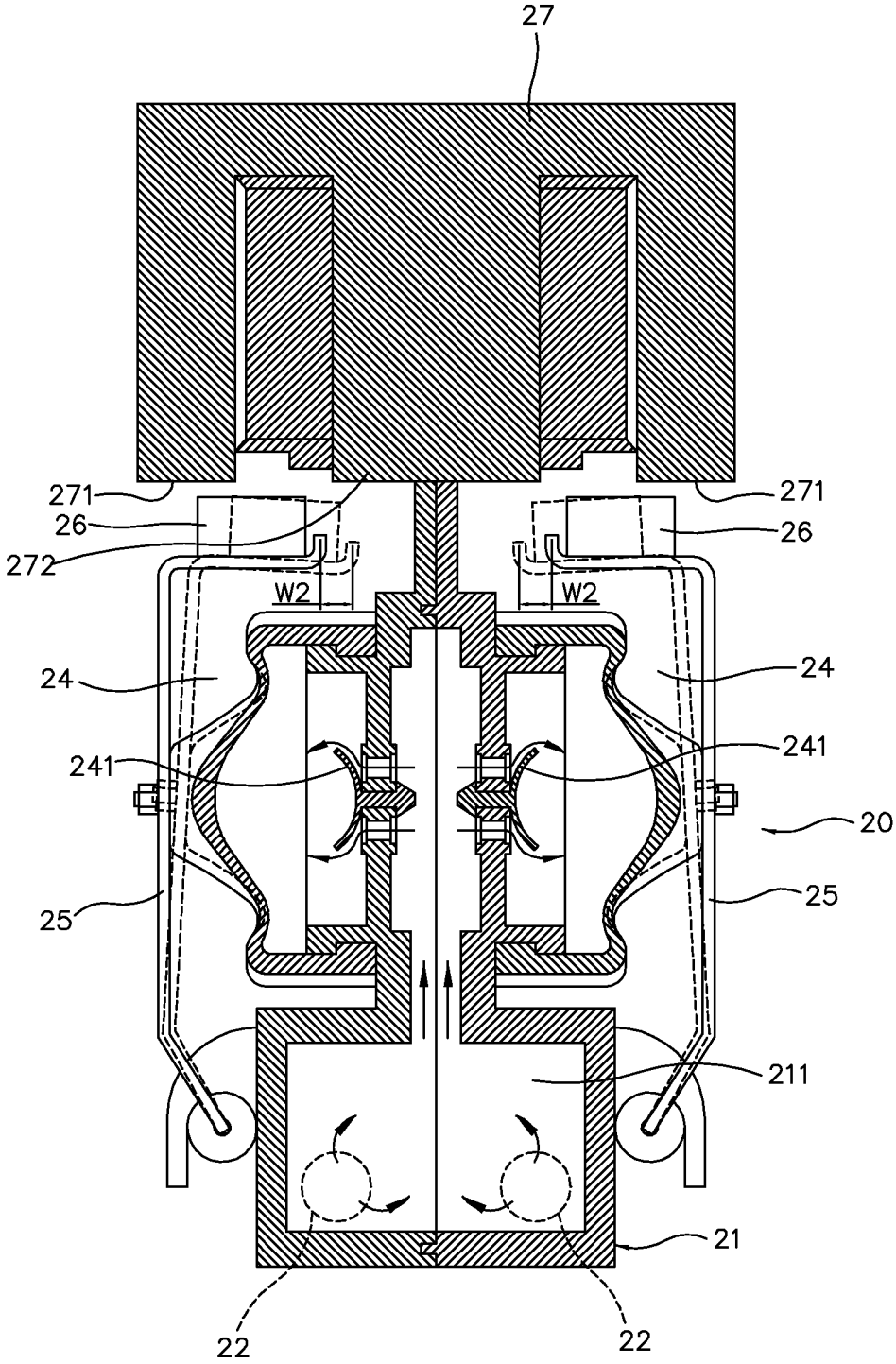
FIG. 10 is a schematic diagram of the electromagnetic pump according to the above preferred embodiment of the present invention illustrating the swinging of the swing arms with medium frequency and medium amplitude.
Figure 11:
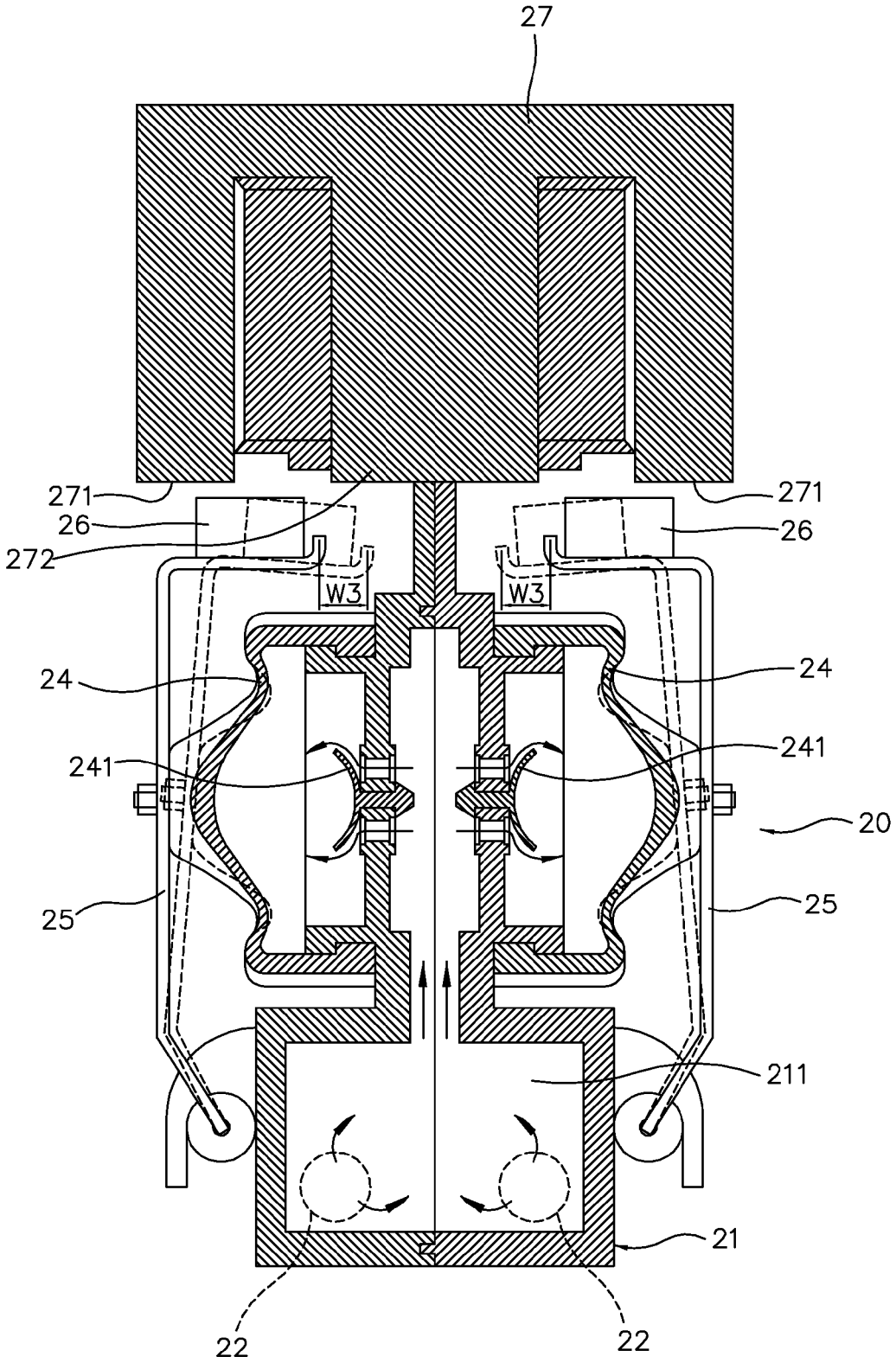
FIG. 11 is a schematic diagram of the electromagnetic pump according to the above preferred embodiment of the present invention illustrating the swinging of the swing arms with minimum frequency and maximum amplitude.
Figure 12:
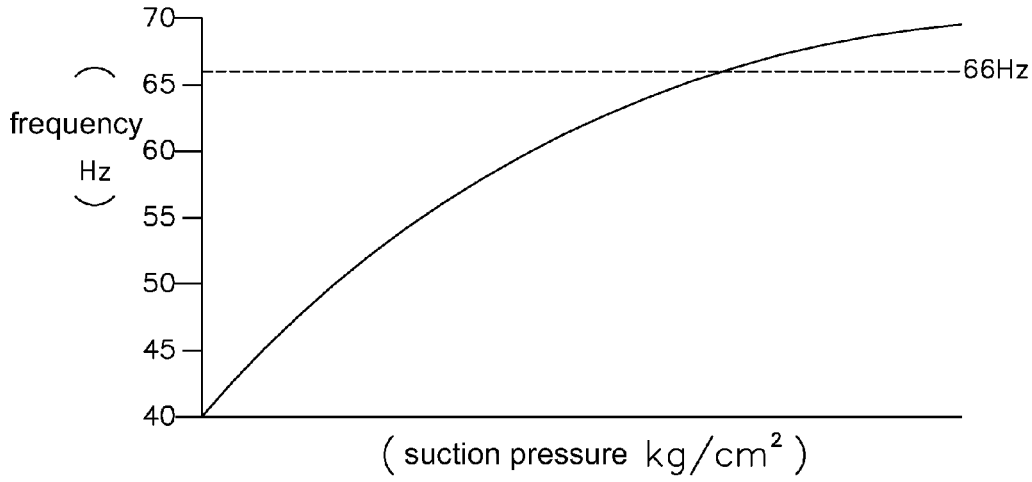
FIG. 12 is a diagram showing the relationship between the oscillating frequency and the suction pressure according to the above preferred embodiment of the present invention.
Figure 13:
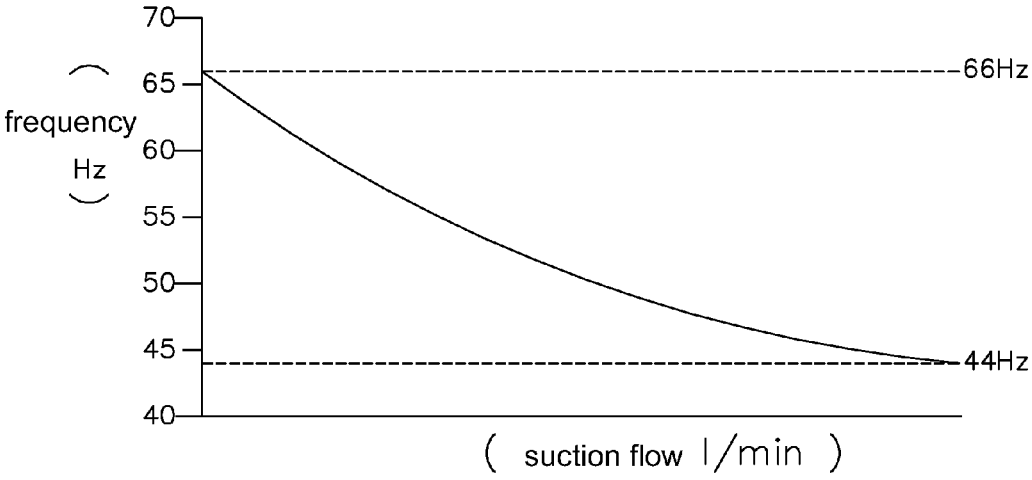
FIG. 13 is a diagram showing the relationship between the oscillating frequency and the suction flow according to the above preferred embodiment of the present invention.

Referring to FIGS. 9 to 11, the higher the oscillating frequency of the oscillator circuit 43 of the frequency converter circuit 40 of the present invention, the higher the speed of the switching between the N-phase and the S-phase of the electromagnetic device 27 is. That further causes the reciprocating swinging of the swing arms 25 to have a higher speed, a higher frequency and smaller amplitude, shown as W1 in FIG. 9. Referring to FIGS. 12 to 13, as the swing arms 25 reciprocatingly swing with a higher speed and a higher frequency, the suction frequency of the electromagnetic pump 20 correspondingly increases rapidly to increase the suction pressure, and that as the swing arms 25 reciprocatingly swing with smaller amplitude, the suction flow of the electromagnetic pump 20 correspondingly decreases. When the oscillator frequency of the oscillator circuit 43 is adjusted to a lower frequency such as 43 Hz, the speed of the switching between the N-phase and the S-phase of the electromagnetic device 27 decreases to further cause the reciprocating swinging of the swing arms 25 to have a lower speed, a lower frequency and larger amplitude, shown as W3 in FIG. 11. Due to the decrease of the swing speed of the swing arms 25, the suction pressure of the electromagnetic pump 20 decreases and due to the increase of the swing amplitude of the swing arms 25, the suction flow of the electromagnetic pump 20 greatly increases. Similarly, when the oscillating frequency of the oscillator circuit 43 is adjusted to a middle frequency such as 55 Hz, the reciprocating swinging of the swing arms 25 has a medium speed, a medium frequency and medium amplitude, shown as W2 in FIG. 10. At this time, the suction pressure and the suction flow of the electromagnetic pump 20 are medium. In view of above, it is appreciated that the electromagnetic pump 20 could have a higher suction pressure and a lower suction flow by means of adjusting the oscillating frequency of the oscillator circuit 43 to a higher frequency, and the electromagnetic pump 20 could have a lower suction pressure and a higher suction flow by means of adjusting the oscillating frequency of the oscillator circuit 43 to a lower frequency.

With the characters of the electromagnetic pump mentioned above, the electromagnetic pump could be utilized in the medical apparatus and instruments that are required to contact with human body, so as to implement the functions thereof. As mentioned above, when the electromagnetic pump is used with a snot suction device, the electromagnetic pump 20 could be adjusted to a low frequency type, i.e. the type of low suction pressure and high suction flow while the patient has a lot of snot. And, if the patient has viscous snot or booger, the electromagnetic pump 20 could be adjusted to a high frequency type, i.e. the type of high suction pressure and low suction flow, in order to easily draw the viscous snot or booger out. Furthermore, when use the electromagnetic pump with a nose cleaner, the electromagnetic pump 20 could be adjusted to a low oscillating frequency type to make the fluid discharged slowly and softly to avoid the choke and the hurt to the nasal sinuses. When the user feels the force of the fluid is not big enough, the electromagnetic pump 20 could be adjusted to a high oscillating frequency type to make the fluid discharge have a force big enough. Besides, when use the electromagnetic pump with an atomization treatment device, the electromagnetic pump 20 could be adjusted to a highest oscillating frequency type to make the gas discharged from the electromagnetic having a highest pressure to atomize the medicine into smallest granules for better absorption.

Figure 14A:
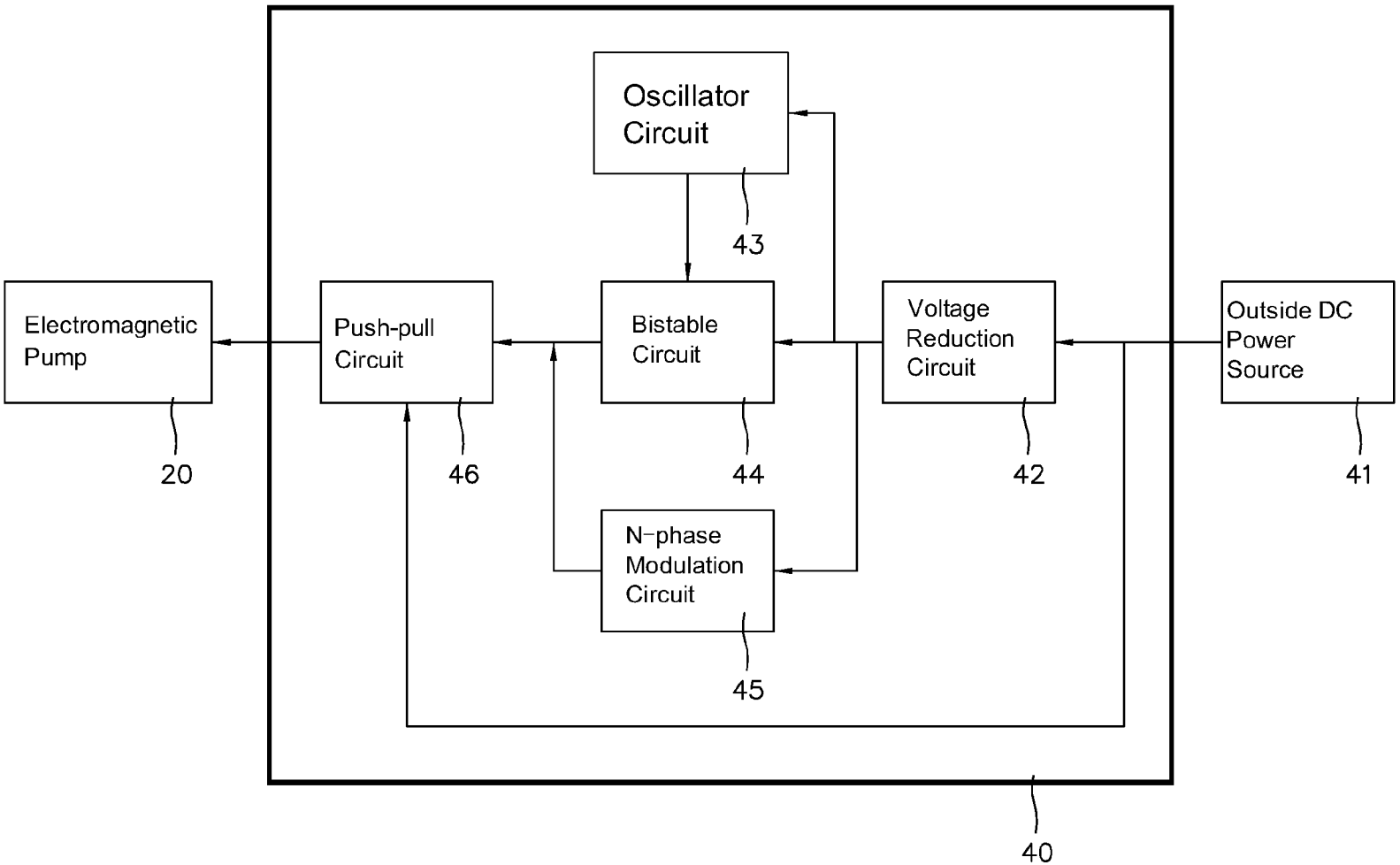
FIG. 14A is a block flow chart of the frequency converter circuit according to a second embodiment of the present invention.
Figure 14B:
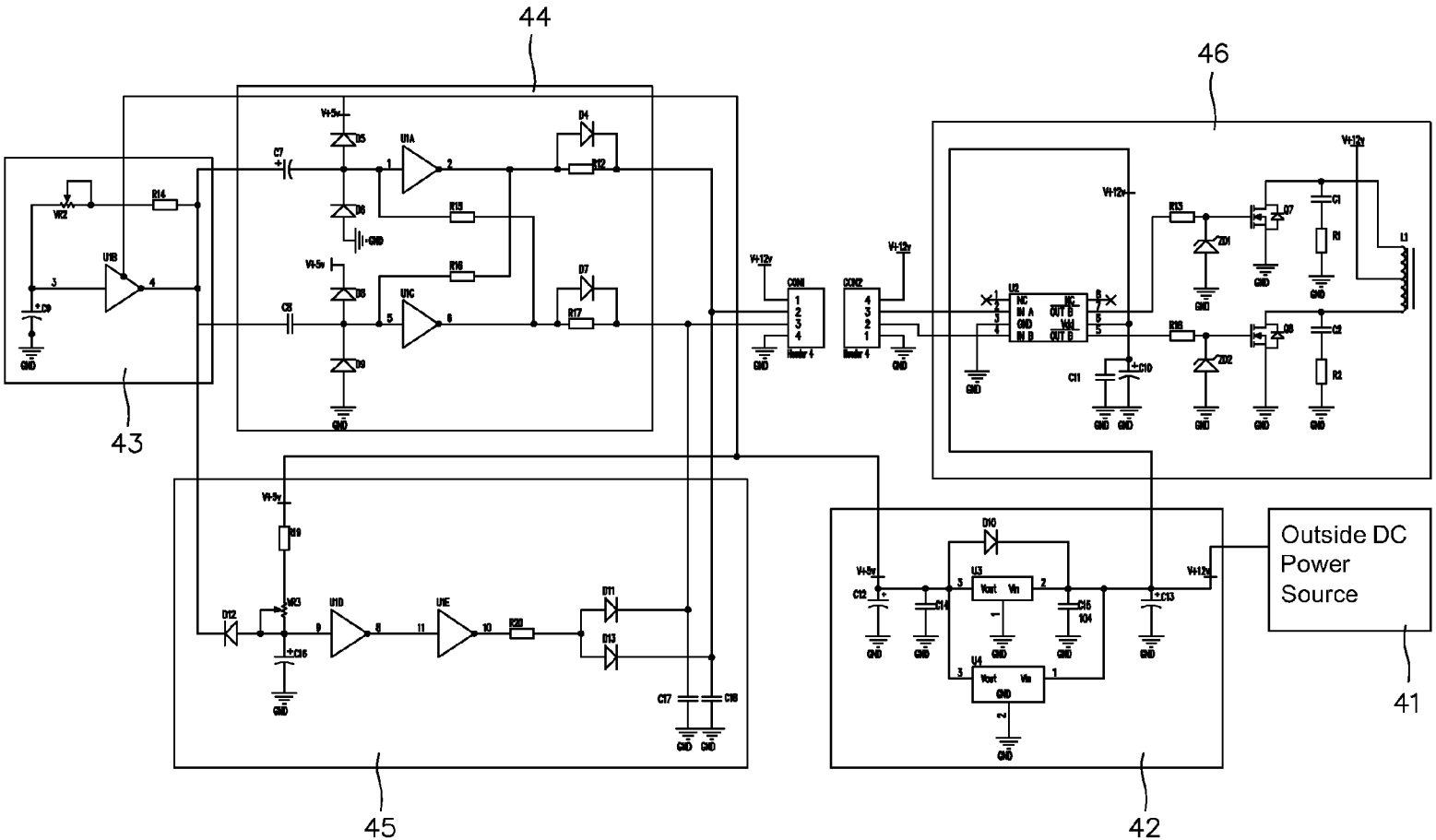
FIG. 14B is a circuit view of the frequency converter circuit of FIG. 14A.

Referring to FIGS. 14A and 14B, a frequency converter circuit 40 of a snot suction device according to a second preferred embodiment of the present invention is illustrated, which further comprises an N-phase modulation circuit 45 generating an N-phase oscillating signal. The N-phase stimulus signal and the S-phase stimulus signal generated in the bistable circuit 44 are mixed with the N-phase oscillating signal respectively to enhance the N-phase stimulus signal while balance the S-phase stimulus signal, i.e. to enhance the magnetic field strength of the N-phase of the electromagnetic device 27 while balance the magnetic field strength of the S-phase of the electromagnetic device 27.

Figure 15:
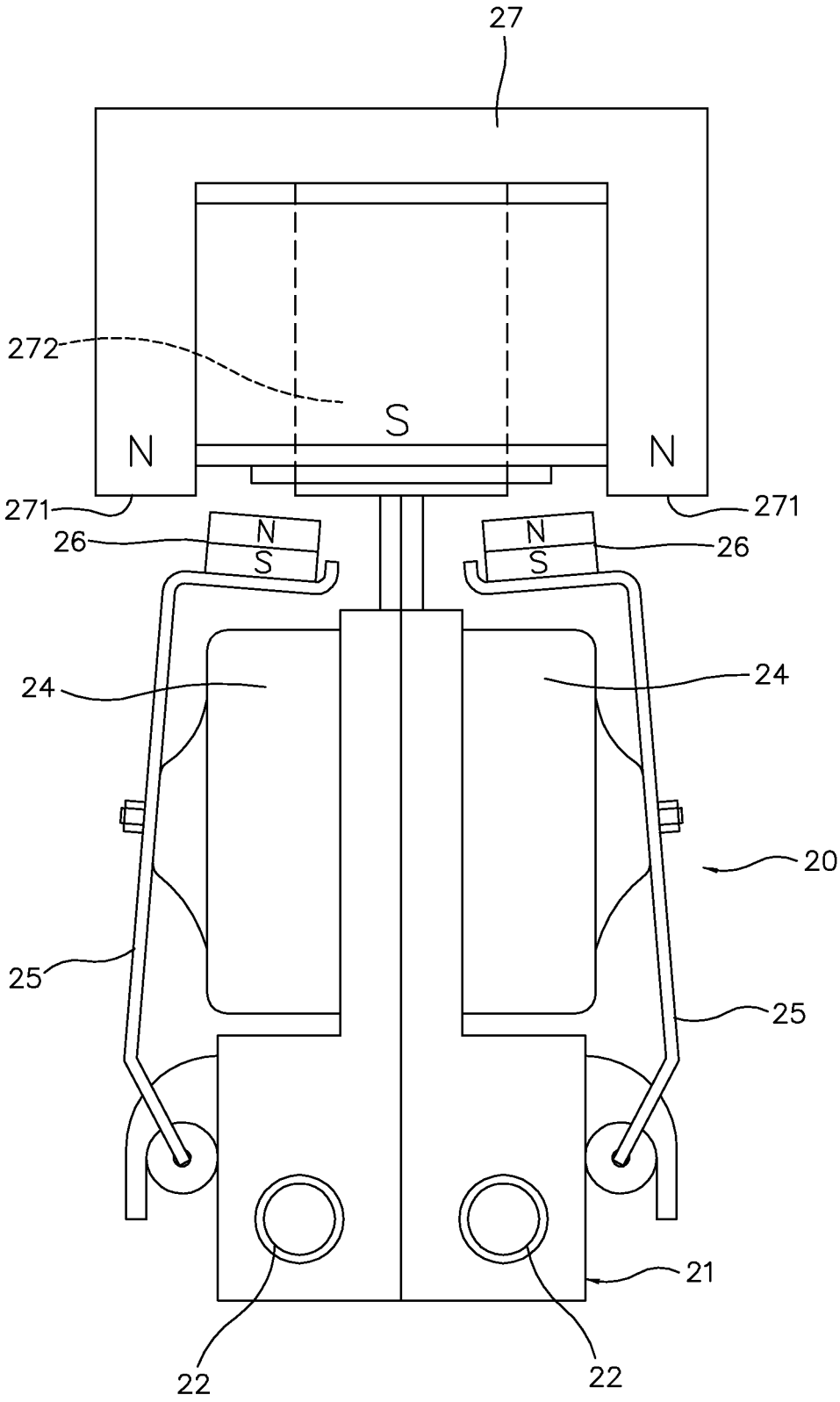
FIG. 15 is a schematic diagram showing the change of the inward swinging of the swing arms after the N-phase modulation circuit of the frequency converter circuit is activated according to the above preferred embodiment of the present invention.
Figure 16:
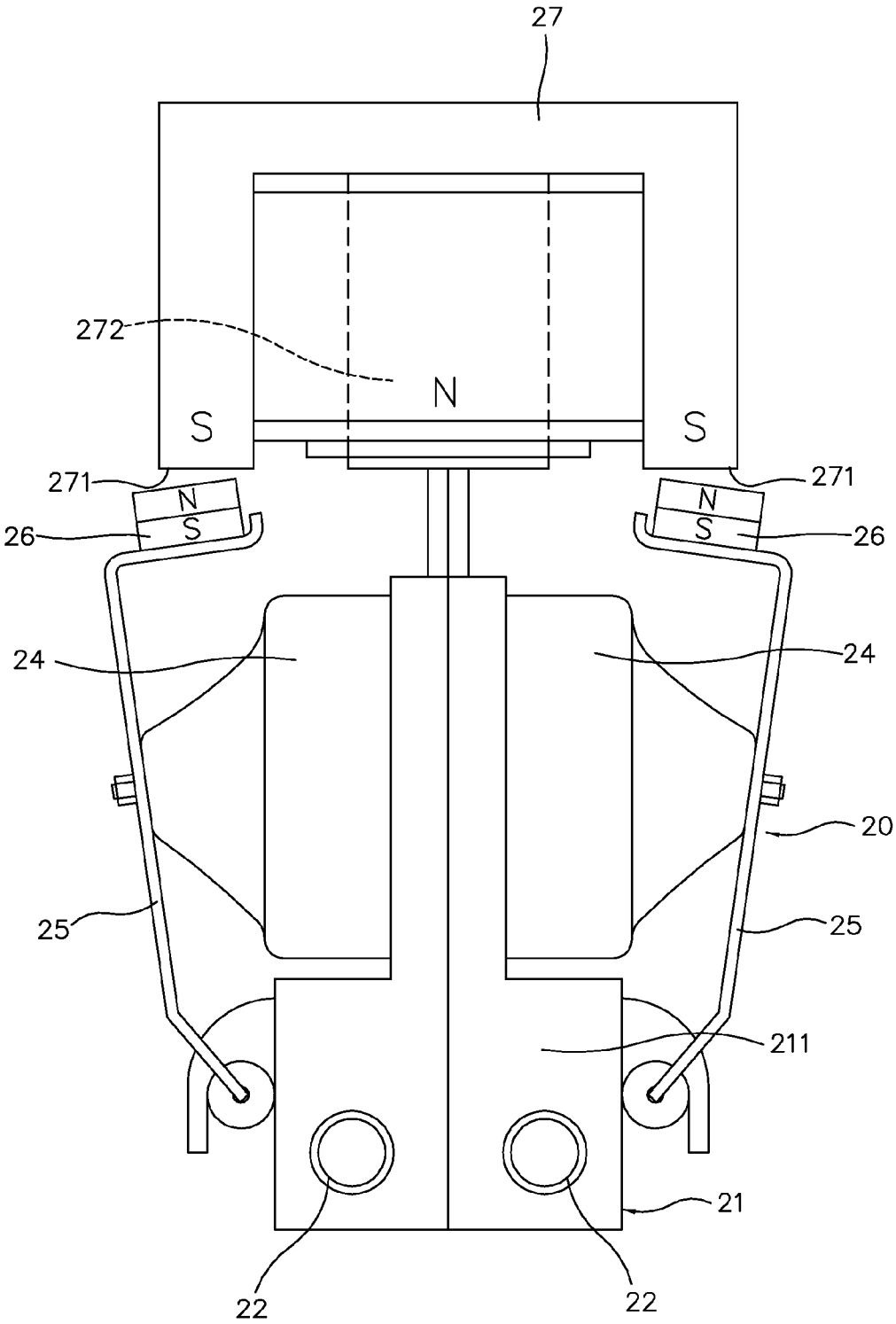
FIG. 16 is a schematic diagram showing the change of the outward swinging of the swing arms after the N-phase modulation circuit of the frequency converter circuit is activated according to the above preferred embodiment of the present invention.

Referring to FIG. 15, when the modulation circuit 45 is activated, the two side magnetic members 271 of the electromagnetic device 27 are switched to the N-phase and switch the middle magnetic member 272 of the electromagnetic device 27 to the S-phase. As the magnetic members 26 are set to have the outside surfaces of N-phase and the inside surfaces of S-phase, the magnetic members 26 are a little attracted by the S-phase middle magnetic member 272 of the electromagnetic device 27, which causes the swing arms 25 swinging toward the middle with a lower speed and a smaller force. Accordingly, the electromagnetic pump 20 has a lower discharge pressure and a lower discharge flow. Referring to FIG. 16, the middle magnetic member 272 of the electromagnetic device 27 is switched to the N-phase and the two side magnetic members 271 of the electromagnetic device 27 are switched to the S-phase. Due to the mixing of the modulation circuit 45, the N-phase stimulus signal is enhanced to cause the N-phase middle magnetic member 272 of the electromagnetic device 27 having a more powerful magnetic field strength to repulse the magnetic members 26. That causes the swing arms 25 swinging outwardly with an increased speed and an increased force. Furthermore, the width of the swing amplitude of the swing arms 25 swinging outwardly might be coupled to be increased. Accordingly, the suction pressure and the suction flow of the electromagnetic pump 20 are increased. Thereby, when the modulation circuit 45 is activated, the swing arms 25 swing outwardly with a higher speed, a bigger force and a bigger width of swing amplitude while swinging toward the middle with a lower speed, a smaller force and a smaller width of swing amplitude. The modulation circuit 45 is arranged to enhance the suction pressure of the electromagnetic pump 20 and to decrease the discharge pressure of the electromagnetic pump 20.

Hence, the modulation circuit 45 of the electromagnetic pump 20 is used with the medical apparatus and instruments, such as a snot suction device. When the viscous snot or booger is hard to drawn out, the modulation circuit 45 could be adjusted to increase the suction pressure of the electromagnetic pump 20 to easily draw the viscous snot or booger out. Referring to FIG. 25, the modulation circuit 45 could be connected with a keypad 35 outside, which is arranged to activate and adjust the modulation circuit 45.

Figure 17A:
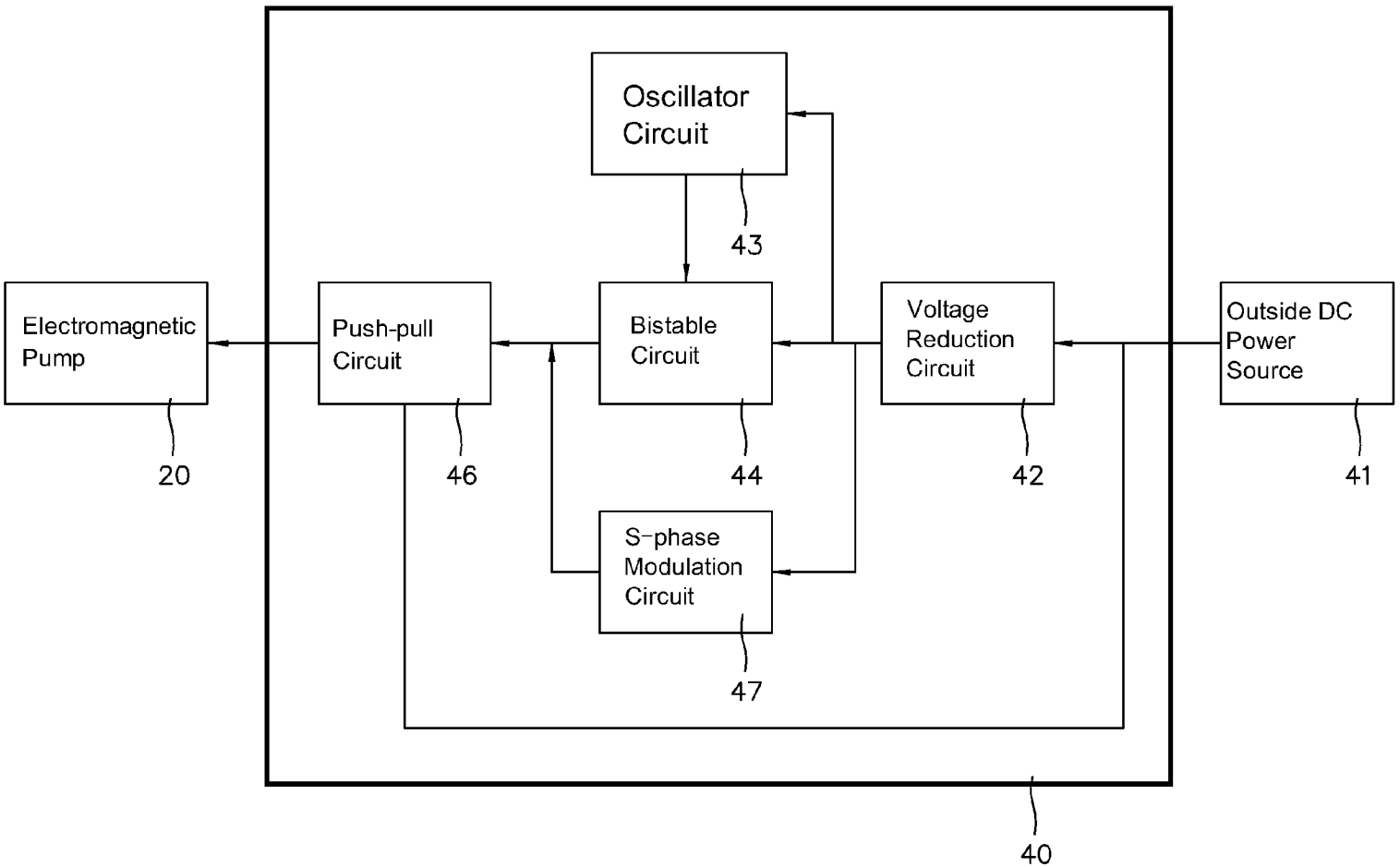
FIG. 17A is a block flow chart of the frequency converter circuit according to a third embodiment of the present invention.
Figure 17B:
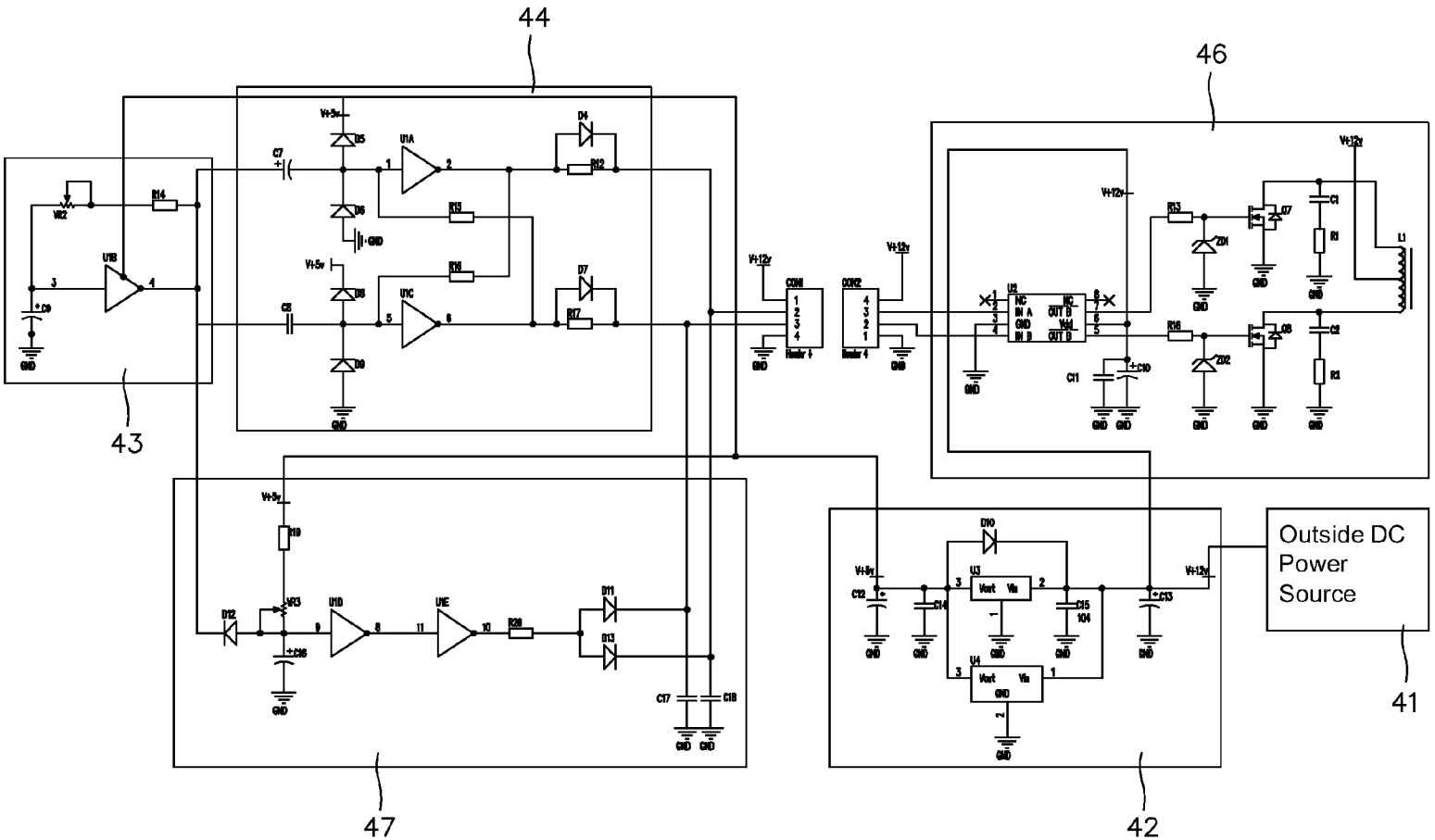
FIG. 17B is a circuit view of the frequency converter circuit of FIG. 17A.
Figure 18:
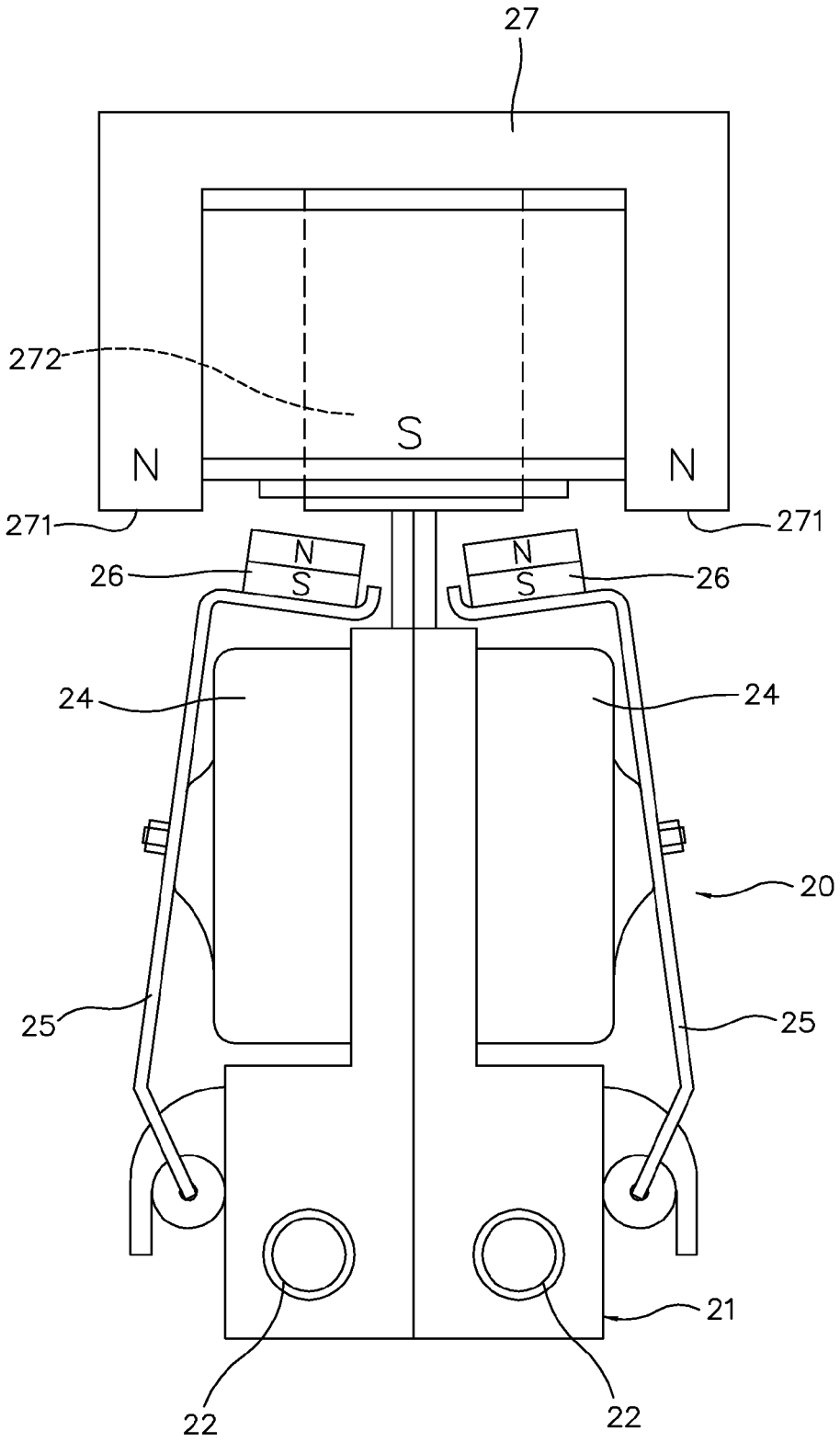
FIG. 18 is a schematic diagram showing the change of the inward swinging of the swing arms after the S-phase modulation circuit of the frequency converter circuit is activated according to the above preferred embodiment of the present invention.

Referring to FIGS. 17A and 17B, a frequency converter circuit 40 of a snot suction device according to the second preferred embodiment of the present invention is illustrated, which further comprises an S-phase modulation circuit 47 generating an S-phase oscillating signal. The N-phase stimulus signal and the S-phase stimulus signal generated in the bistable circuit 44 are mixed with the S-phase oscillating signal respectively to enhance the S-phase stimulus signal while balancing the N-phase stimulus signal, i.e. to enhance the magnetic field strength of the S-phase of the electromagnetic device 27 while balancing the magnetic field strength of the N-phase of the electromagnetic device 27. Referring to FIG. 18, when the S-phase modulation circuit 47 is activated, the two side magnetic members 271 of the electromagnetic device 27 is switched to the N-phase and switch the middle magnetic member 272 of the electromagnetic device 27 to the S-phase. As the magnetic members 26 are set to have the outside surfaces of N-phase and the inside surfaces of S-phase, the S-phase stimulus signal is enhanced by the S-phase oscillating signal of the S-phase modulation circuit 47, thereby the S-phase middle magnetic member 272 of the electromagnetic device 27 will have a more powerful magnetic force. The magnetic members 26 are much attracted by the S-phase middle magnetic member 272 of the electromagnetic device 27, which causes the swing arms 25 swinging toward the middle with a higher speed and a bigger force. Furthermore, the width of the swing amplitude of the swing arms 25 swinging inwardly might be coupled to be increased. Accordingly, the electromagnetic pump 20 has a higher discharge pressure.

Figure 19:
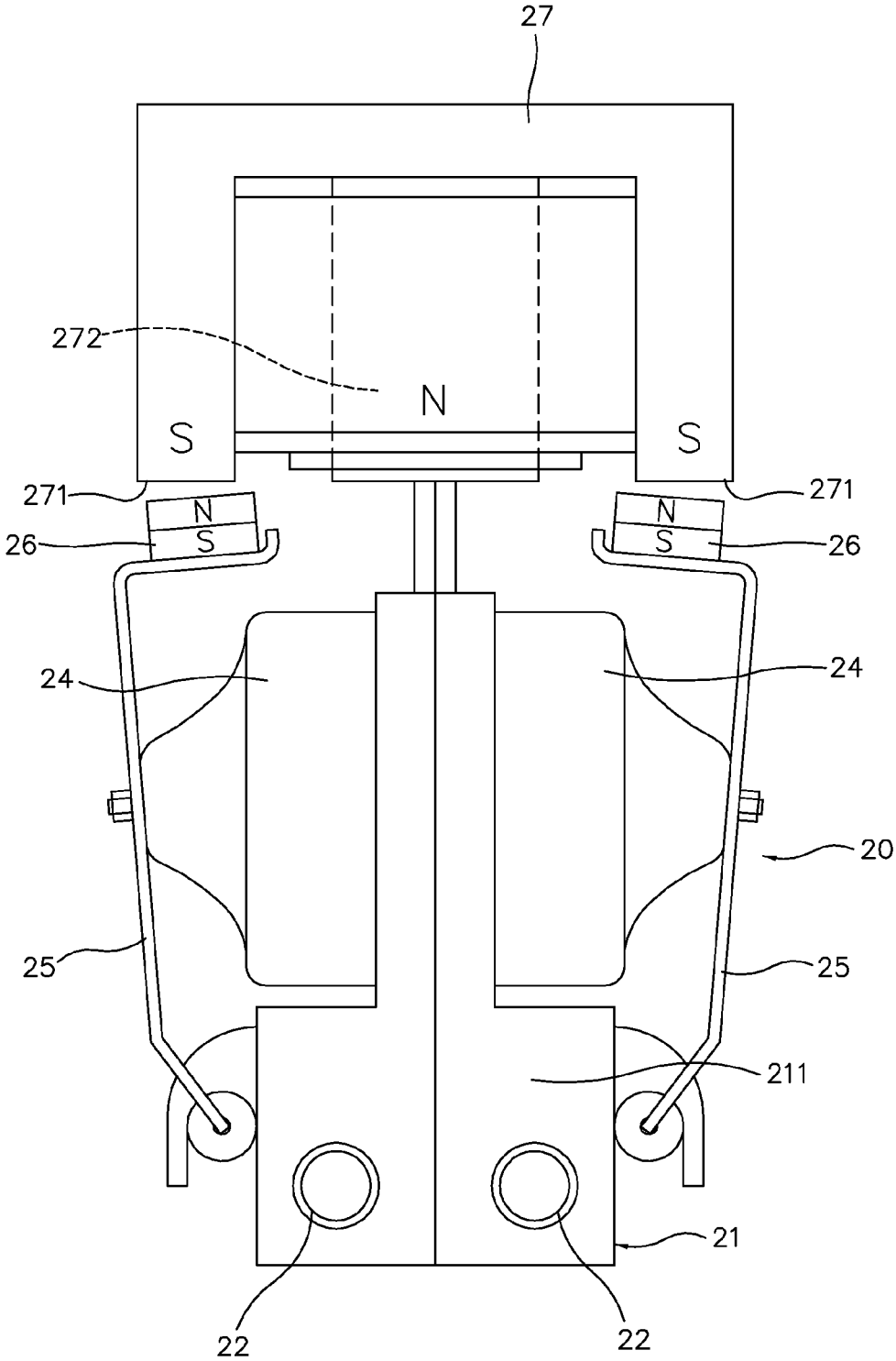
FIG. 19 is a schematic diagram showing the change of the outward swinging of the swing arms after the S-phase modulation circuit of the frequency converter circuit is activated according to the above preferred embodiment of the present invention.

Referring to FIG. 19, the middle magnetic member 272 of the electromagnetic device 27 is switched to the N-phase and the two side magnetic members 271 of the electromagnetic device 27 are switched to the S-phase. The magnetic members 26 are little repulsed by the N-phase middle magnetic member 272 of the electromagnetic device 27. Accordingly, the swing arms 25 swing outwardly with a decreased speed and a decreased force. Furthermore, the width of the swing amplitude of the swing arms 25 swinging outwardly might be coupled to be decreased. Accordingly, the suction pressure of the electromagnetic pump 20 is decreased. Thereby, when the modulation circuit 47 is activated, the swing arms 25 swing toward the middle with a higher speed, a bigger force and a bigger width of the swing amplitude while swinging outwardly with a lower speed, a smaller force and a smaller width of swing amplitude. The modulation circuit 47 is arranged to enhance the discharge pressure of the electromagnetic pump 20 and to decrease the suction pressure of the electromagnetic pump 20.

Hence, the modulation circuit 47 of the electromagnetic pump 20 is used with the medical apparatus and instruments, such as an atomization treatment device. When the electromagnetic pump with an atomization treatment device is used, the gas discharged from the electromagnetic could be better atomized. Referring to FIG. 25, the modulation circuit 47 could be connected with a keypad 35 outside, which is arranged to activate and adjust the modulation circuit 47.

Figure 20:
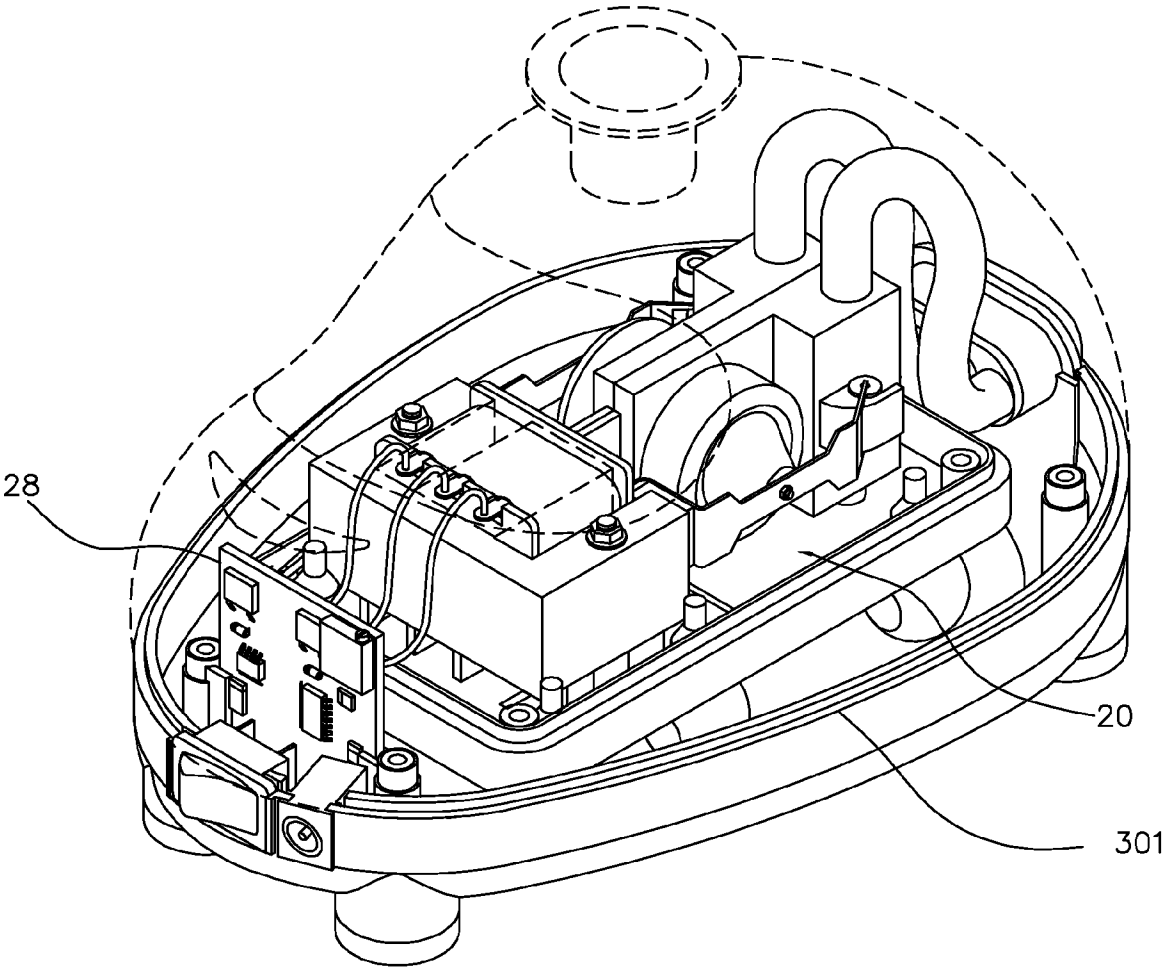
FIG. 20 is a schematic diagram showing the frequency converter circuit of the present invention is used in the medical apparatus and instruments.
Figure 27:
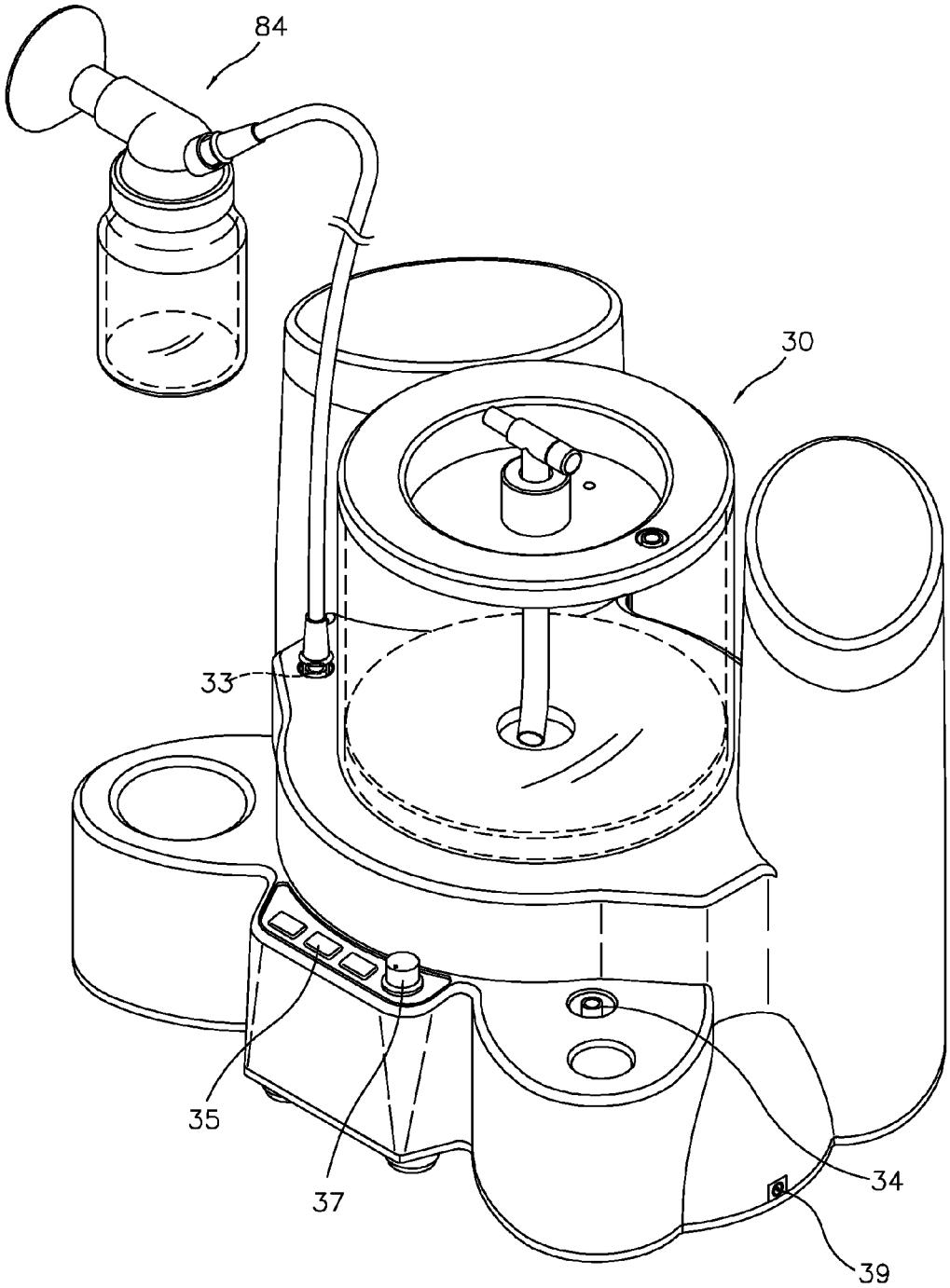
FIG. 27 is a schematic diagram illustrating the electromagnetic pump with the frequency converter circuit according to a preferred embodiment of the present invention is used with a lattices suction device.
Figure 28:
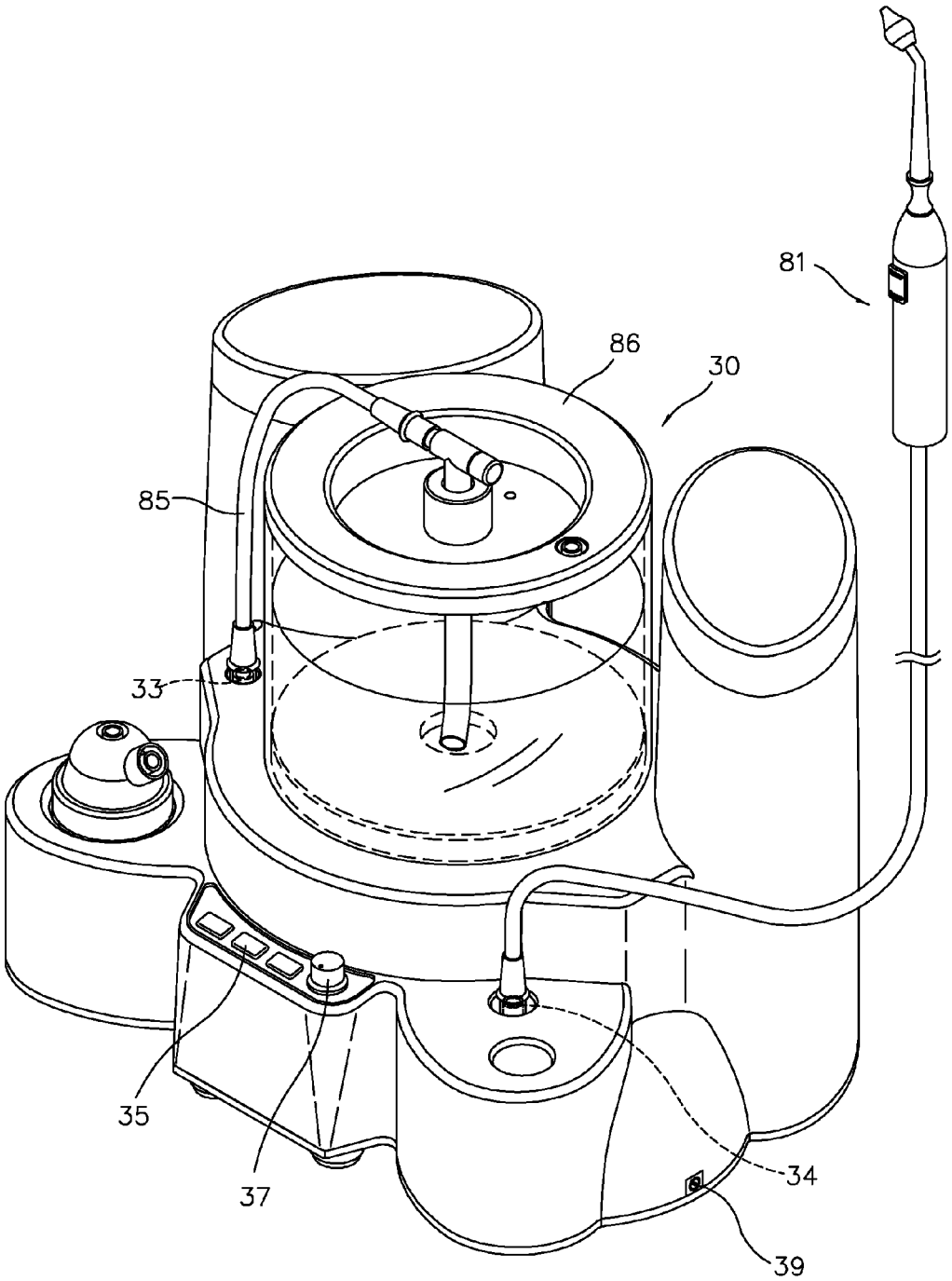
FIG. 28 is a schematic diagram illustrating the electromagnetic pump with the frequency converter circuit according to a preferred embodiment of the present invention is used with a nose-washing tool.
Figure 29:
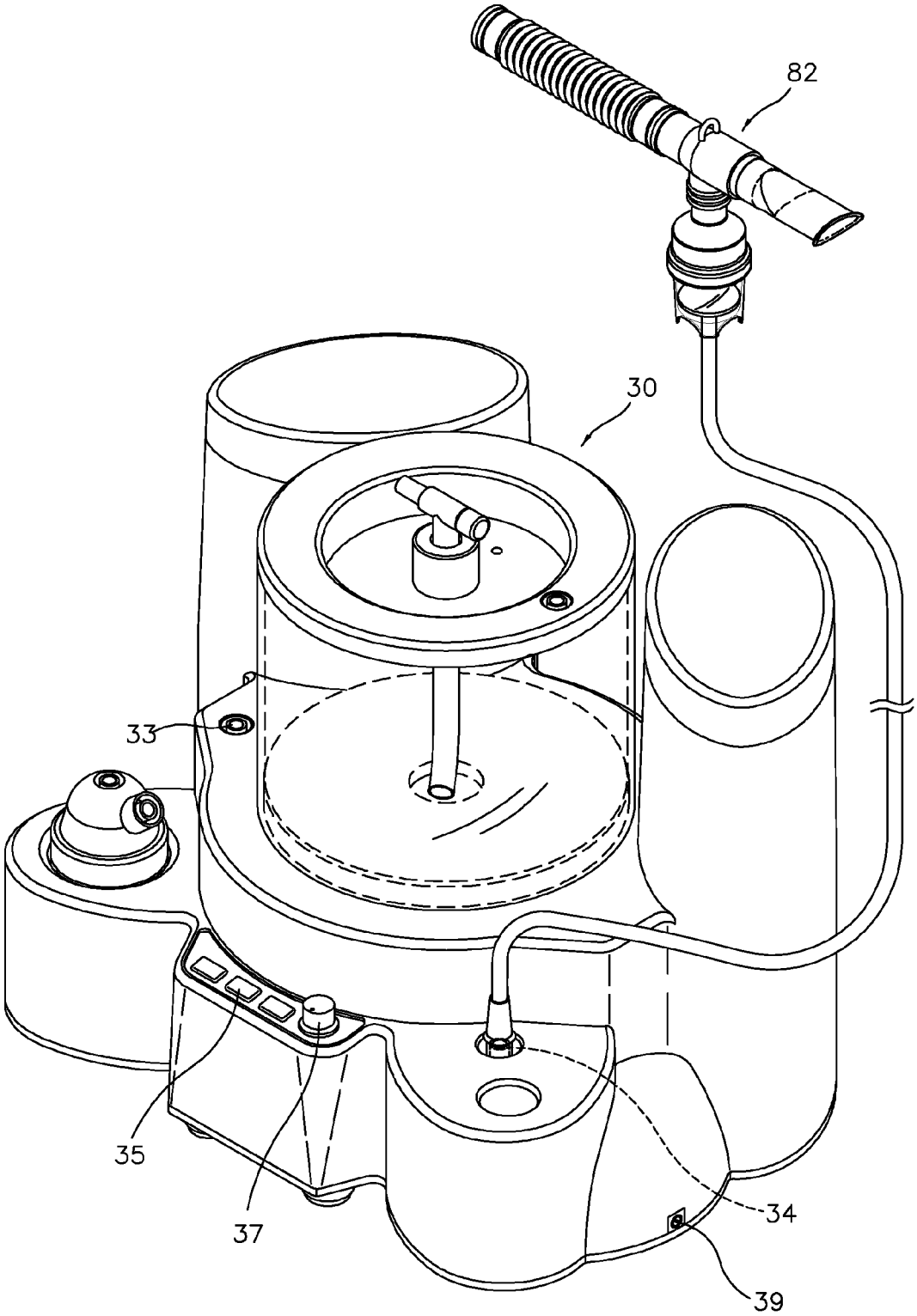
FIG. 29 is a schematic diagram illustrating the electromagnetic pump with the frequency converter circuit according to a preferred embodiment of the present invention is used with a handset atomizer.
Figure 30:
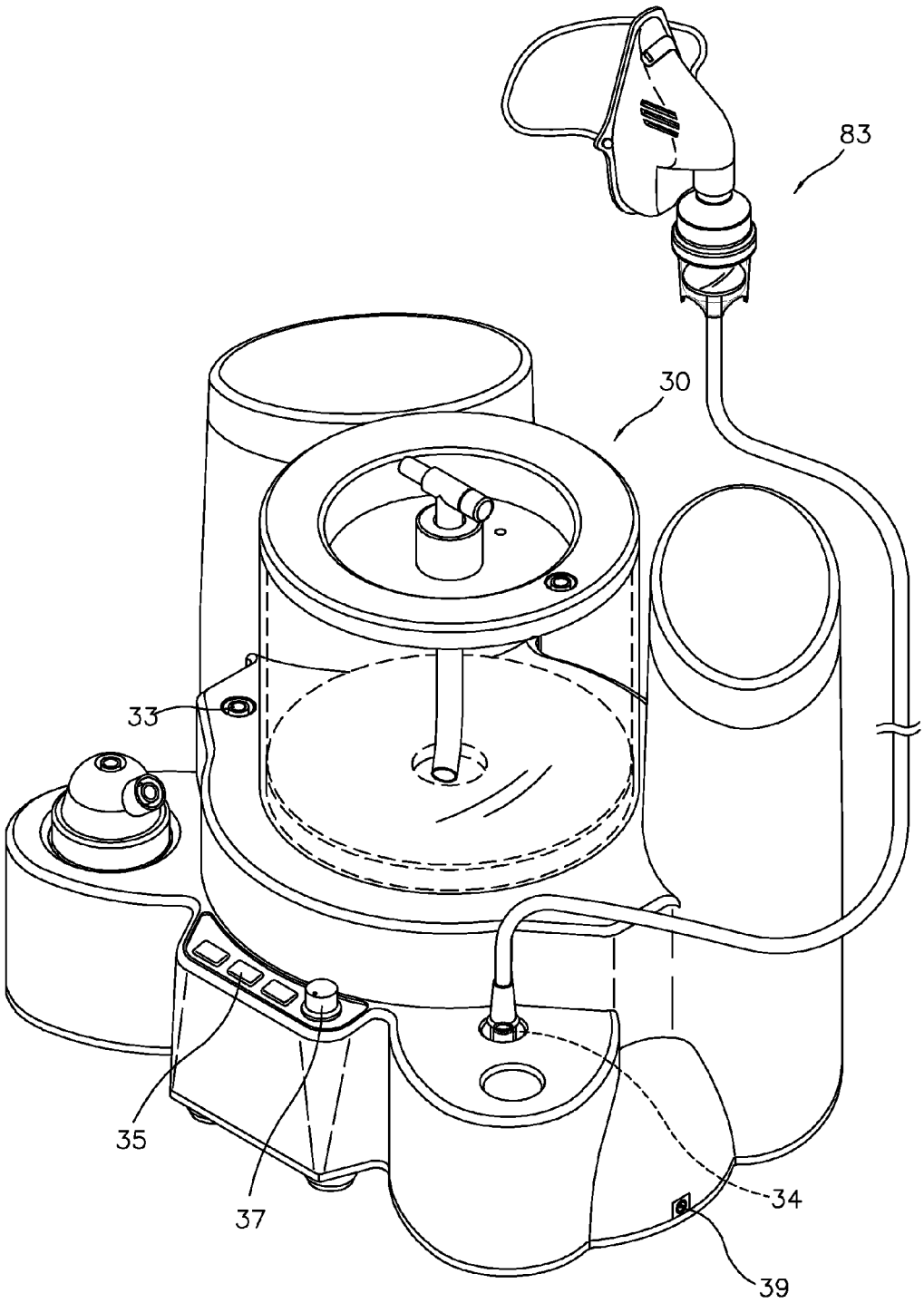
FIG. 30 is a schematic diagram illustrating the electromagnetic pump with the frequency converter circuit according to a preferred embodiment of the present invention is used with a spray helmet.

Referring to FIG. 20, the electromagnetic pump 20 and the circuit board 28 of the present invention could be used in the medical apparatus and instruments. Referring to FIG. 20, the electromagnetic pump 20 and the circuit board 28 are disposed in a housing 301, which could be a snot suction device. Referring to FIGS. 24, 26 to 30, the electromagnetic pump 20 and the circuit board 28 could be contained in a body 30. The body 30 has at least one negative pressure joint 33 and at least one positive pressure joint 34. The negative pressure joint 33 is communicated with the inlet tube 22 of the electromagnetic pump 20 through a negative pressure channel 31. The positive pressure joint 34 is communicated with the outlet tube 23 of the electromagnetic pump 20 through a positive pressure channel 32. The body 30 provides a receptacle 39 for a transformer rectifier unit 50 (TRU), a battery 60 or a wire 70 of in-car cigarette lighter. The negative pressure joint 33 could be connected with a suction device 80 to draw snot as shown in FIG. 26, or could be connected with a lattices suction device 84 to draw the lattices as shown in FIG. 27. The positive pressure joint 34 could be connected with a nose-washing tool 81 to clean the nasal cavity as shown in FIG. 28. The body 30 has a container 86 for storing a cleaning solution therein, wherein the negative pressure joint 33 is communicated with the container through a tube 85. When the electromagnetic pump 20 is activated, the cleaning solution in the container 86 could be discharged from the nose-washing tool 81. Besides, the positive pressure joint 34 could be communicated with a handset atomizer 82 to atomize the medicine, which will be drawn in the body when the user breathes, as shown in FIG. 29. Besides, the positive pressure joint 34 could be communicated with a spray helmet 83 to atomize the medicine, which will be drawn in the body when the user breathes, as shown in FIG. 30.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electromagnetic pump, comprising:

an electromagnetic device surrounded with coils driving at least one swing arm swinging forth and back, which further drives a bladder expanded and compressed to respectively draw a fluid into said pump from one end thereof and discharge said fluid from another end of said pump; and a frequency converter circuit which comprises an oscillator circuit, a bistable circuit and a push-pull circuit, wherein said oscillator circuit oscillates to transform DC into a single-phase oscillating signal, wherein said bistable circuit splits said single-phase oscillating signal into a N-phase stimulus signal and a S-phase stimulus signal, wherein said push-pull circuit amplifies and transports said N-phase stimulus signal and said S-phase stimulus signal to said electromagnetic pump, wherein said frequency converter circuit is arranged to use DC to drive said electromagnetic pump, wherein the oscillating frequency of said oscillator circuit is adjusted to change a suction pressure, a suction flow, a discharge pressure, and a discharge flow of said electromagnetic pump.

2. The electromagnetic pump, as recited in claim 1, wherein said frequency converter circuit comprises a modulation circuit which generates a single-phase oscillating signal, wherein said N-phase stimulus signal and said S-phase stimulus signal generated in said bistable circuit are mixed with said single-phase oscillating signal respectively to selectively enhance said N-phase stimulus signal while balancing said S-phase stimulus signal or said S-phase stimulus signal while balancing said N-phase stimulus signal, so as to further respectively change the suction pressure and the discharge pressure of said electromagnetic pump.

3. The electromagnetic pump, as recited in claim 1, wherein said electromagnetic device is provided on one side of said electromagnetic pump while a pump housing is provided on the other side thereof, wherein at least one outside surface of said pump housing provides a stretchable and elastic bladder which further provides a swing arm thereon, wherein one end of said swing arm is pivotally mounted on outer side of said pump housing and a magnetic member is provided on the other end of said swing arm with a distance from said electromagnetic device, wherein an inside of said pump housing is divided into a first chamber and a second chamber, wherein said first chamber is communicated with at least one inlet tube and said second chamber is communicated with at least one outlet tube, wherein one check valve is provided between each of said first and second chambers and said corresponding bladder, wherein said swing arm swings reciprocatingly to cause said electromagnetic pump to draw a fluid into said chambers from said inlet tube and to discharge said fluid from said outlet tube.

4. The electromagnetic pump, as recited in claim 1, wherein said frequency converter circuit further comprises a voltage reduction circuit, wherein said voltage reduction circuit transforms DC inputted into said frequency converter circuit into DC with a lower voltage, which is supplied to each said circuit as the working current, wherein said voltage reduction circuit is able to be used to stabilize the voltage.

5. The electromagnetic pump, as recited in claim 1, wherein said DC transported to said frequency converter circuit is supplied by a transformer rectifier unit.

6. The electromagnetic pump, as recited in claim 1, wherein said DC transported to said frequency converter circuit is supplied by a battery.

7. The electromagnetic pump, as recited in claim 1, wherein said DC transported to said frequency converter circuit is supplied by an in-car cigarette lighter through a wire.

8. The electromagnetic pump, as recited in claim 2, wherein said frequency converter circuit further comprises a voltage reduction circuit, wherein said voltage reduction circuit transforms DC inputted into said frequency converter circuit into DC with a lower voltage, which is supplied to each said circuit as the working current, wherein said voltage reduction circuit is able to be used to stabilize the voltage.

* * * * *